US010792914B2

(12) United States Patent
Hirabayashi

(10) Patent No.: US 10,792,914 B2
(45) Date of Patent: Oct. 6, 2020

(54) IMAGE RECORDING DEVICE AND IMAGE RECORDING METHOD

(71) Applicant: FUJIFILM Corporation, Tokyo (JP)

(72) Inventor: Yasutoshi Hirabayashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/424,495

(22) Filed: May 29, 2019

(65) Prior Publication Data

US 2019/0275791 A1 Sep. 12, 2019

Related U.S. Application Data

(63) Continuation of application No. PCT/JP2017/042721, filed on Nov. 29, 2017.

(30) Foreign Application Priority Data

Dec. 2, 2016 (JP) ..... 2016-235213

(51) Int. Cl.
*B41J 2/045* (2006.01)
*B41J 2/205* (2006.01)
(Continued)

(52) U.S. Cl.
CPC ..... *B41J 2/0451* (2013.01); *B41J 2/01* (2013.01); *B41J 2/015* (2013.01); *B41J 2/04586* (2013.01);
(Continued)

(58) Field of Classification Search
CPC ..... B41J 2/04595
See application file for complete search history.

(56) References Cited

U.S. PATENT DOCUMENTS 7,075,677 B1 * 7/2006 Silverbrook ..... B41J 2/2139 358/1.9
2005/0073546 A1 4/2005 Kuwahara et al.
(Continued)

FOREIGN PATENT DOCUMENTS

JP 2004122521 4/2004
JP 2015047803 3/2015
(Continued)

OTHER PUBLICATIONS

"International Search Report (Form PCT/ISA/210)" of PCT/JP2017/042721, dated Jan. 16, 2018, with English translation thereof, pp. 1-5.
(Continued)

*Primary Examiner* — Shelby L Fidler
(74) *Attorney, Agent, or Firm* — JCIPRNET

(57) ABSTRACT

An image recording device and an image recording method capable of matching landing positions between droplet types in a consecutive ejection drive method are provided. The object is resolved by an image recording device in which a drive waveform for forming a dot of a small droplet is a drive waveform for ejecting a liquid droplet by a first ejection waveform element arranged in a first half of one drive cycle, and a drive waveform for forming a dot of a medium droplet is a drive waveform for ejecting the liquid droplet by the first ejection waveform element and a second ejection waveform element arranged after the first ejection waveform element in time series, and the liquid droplet ejected by the first ejection waveform element and the liquid droplet ejected by the second ejection waveform element are not combined while reaching onto a recording medium.

11 Claims, 22 Drawing Sheets

(51) Int. Cl.
*B41J 2/015* (2006.01)
*B41J 2/01* (2006.01)
*B41J 2/14* (2006.01)

(52) U.S. Cl.
CPC ..... *B41J 2/04588* (2013.01); *B41J 2/04595* (2013.01); *B41J 2/14* (2013.01); *B41J 2/205* (2013.01)

(56) References Cited

U.S. PATENT DOCUMENTS

2006/0279594 A1* 12/2006 Hasegawa ..... B41J 2/04581 347/11
2007/0211092 A1* 9/2007 Shingyohuchi ..... B41J 2/2054 347/10
2012/0218333 A1* 8/2012 Nishikawa ..... B41J 2/04541 347/10
2014/0267481 A1 9/2014 Menzel
2015/0062226 A1 3/2015 Okita
2015/0210078 A1 7/2015 Edlitz et al.
2015/0258785 A1 9/2015 Sudo et al.
2015/0266291 A1* 9/2015 Hasegawa ..... B41J 2/04581 347/9
2015/0336383 A1 11/2015 Otsuka et al.
2016/0254811 A1 9/2016 Otsuka et al.
2016/0347058 A1* 12/2016 Suzuki ..... B41J 2/04516
2017/0165965 A1* 6/2017 Misawa ..... B41J 2/04581
2018/0290445 A1* 10/2018 Misawa ..... B41J 2/04541

FOREIGN PATENT DOCUMENTS

JP 2015174395 10/2015
JP 2015223702 12/2015
JP 2016510703 4/2016
JP 2016074145 5/2016

OTHER PUBLICATIONS

"Written Opinion of the International Searching Authority (Form PCT/ISA/237)" of PCT/JP2017/042721, dated Jan. 16, 2018, with English translation thereof, pp. 1-7.

* cited by examiner

IMAGE RECORDING DEVICE AND IMAGE RECORDING METHOD

CROSS-REFERENCE TO RELATED APPLICATIONS

The present application is a Continuation of PCT International Application No. PCT/JP2017/042721 filed on Nov. 29, 2017 claiming priority under 35 U.S.C § 119(a) to Japanese Patent Application No. 2016-235213 filed on Dec. 2, 2016. Each of the above applications is hereby expressly incorporated by reference, in their entirety, into the present application.

BACKGROUND OF THE INVENTION

1. Field of the Invention

The present invention relates to an image recording device and an image recording method and particularly, to an image recording device and an image recording method controlling the size of a dot by consecutively ejecting a plurality of liquid droplets.

2. Description of the Related Art

A consecutive ejection drive method of controlling the number of drive pulses applied to a liquid droplet ejection element such as a piezoelectric element is known as one method of controlling the amount of liquid droplet ejected from a nozzle in an ink jet recording device. In general, in the consecutive ejection drive method, in order to increase a printing speed, a plurality of drive pulses linearly arranged in time series are prepared, and ink is ejected using selected drive pulses by selecting all drive pulses in large droplet ejection, not selecting early drive pulses of the large droplet ejection in medium droplet ejection, and not selecting early drive pulses of the medium droplet ejection in small droplet ejection.

However, in the case of selecting the drive pulses, ejection of the large droplet and the medium droplet is started at an earlier timing in a drive cycle of a liquid droplet ejection element, but the small droplet is ejected at a late timing in the drive cycle. Thus, the timing of the small droplet landing on a recording medium is later than that of the medium droplet in one drive cycle. In a case where a deviation in landing timing occurs between the small droplet and the medium droplet, a deviation in landing position occurs between the small droplet and the medium droplet in a direction of transport of the recording medium because the recording medium is being transported. Thus, a problem arises in that a high density portion is not solidly covered, or granularity deteriorates.

Regarding such a problem, JP2016-510703A discloses a method for driving a liquid droplet ejection device including an actuator. The method includes a step of applying a first subset having a multi-pulse waveform to the actuator and causing the liquid droplet ejection device to eject a first liquid droplet of fluid in response to the first subset, and a step of applying a second subset having a multi-pulse waveform to the actuator and causing the liquid droplet ejection device to eject a second liquid droplet of fluid in response to the second subset. The first subset includes a drive pulse that is positioned at a time near the start of a clock cycle of the first subset. The first liquid droplet has a smaller capacity than the second liquid droplet.

SUMMARY OF THE INVENTION

In the drive method disclosed in JP2016-510703A, the small droplet is ejected at an early timing in the clock cycle (corresponds to the drive cycle). Thus, a situation in which the landing of the small droplet is later than the landing of the medium droplet can be reduced. However, even in this case, the landing timing of the small droplet cannot be set to match the landing timing of the medium droplet.

The present invention is conceived in view of such a matter. An object of the present invention is to provide an image recording device and an image recording method capable of matching landing positions between droplet types in a consecutive ejection drive method.

An aspect of an image recording device for achieving the object comprises a liquid ejection head including a plurality of nozzles ejecting a liquid droplet, a plurality of pressure chambers respectively communicating with the plurality of nozzles, and a plurality of liquid droplet ejection elements pressurizing liquid in the plurality of pressure chambers, respectively, depending on a supplied drive waveform, a dot forming unit that forms a dot on a recording medium by ejecting the liquid droplet from the plurality of nozzles based on dot data while relatively moving the liquid ejection head and the recording medium in a first direction, a waveform supply unit that supplies a drive waveform for forming at least a dot of a small droplet, a dot of a medium droplet, or a dot of a large droplet of different sizes to the liquid ejection head depending on the dot data, the drive waveform including an ejection waveform element for ejecting the liquid droplet from the nozzle in one drive cycle, a defect specifying unit that specifies a defective nozzle having an ejection malfunction among the plurality of nozzles, and a data acquisition unit that acquires the dot data which includes at least four gradations including the dot of the small droplet, the dot of the medium droplet, the dot of the large droplet, and no dot and complements a dot to be formed by ejection of the defective nozzle by the dot of the large droplet formed by ejection of a nozzle adjacent to the defective nozzle in at least a second direction intersecting the first direction. The drive waveform for forming the dot of the small droplet is a drive waveform for ejecting the liquid droplet by a first ejection waveform element arranged in a first half of the one drive cycle. The drive waveform for forming the dot of the medium droplet is a drive waveform for ejecting the liquid droplet by the first ejection waveform element and a second ejection waveform element arranged after the first ejection waveform element in time series, and the liquid droplet ejected by the first ejection waveform element and the liquid droplet ejected by the second ejection waveform element are not combined while reaching onto the recording medium and are combined on the recording medium. The drive waveform for forming the dot of the large droplet is a drive waveform for ejecting the liquid droplet by the first ejection waveform element and a third ejection waveform element that is arranged after the first ejection waveform element in time series and includes at least a part of the second ejection waveform element, and the liquid droplet ejected by the first ejection waveform element and the liquid droplet ejected by the third ejection waveform element are combined while reaching onto the recording medium.

According to the present aspect, for the small droplet, the liquid droplet is ejected by the first ejection waveform element arranged in the first half of the one drive cycle. For the medium droplet, the liquid droplet is ejected by the first ejection waveform element and the second ejection waveform element arranged after the first ejection waveform element in time series. The liquid droplet ejected by the first ejection waveform element and the liquid droplet ejected by the second ejection waveform element are not combined while reaching onto the recording medium and are combined on the recording medium. Thus, the landing positions of the dot of the small droplet and the dot of the medium droplet can be matched.

It is preferable that the first ejection waveform element includes at least one drive pulse for ejecting the liquid droplet and a dereverberation pulse that is arranged after the at least one drive pulse in time series and is for reducing meniscus vibration after liquid droplet ejection based on the at least one drive pulse, and the liquid droplet ejected by the second ejection waveform element and the liquid droplet ejected by the third ejection waveform element are ejected after the liquid droplet ejected by the first ejection waveform element is separated from the nozzle. Accordingly, the liquid droplet ejected by the second ejection waveform element and the liquid droplet ejected by the third ejection waveform element can be ejected separately from the liquid droplet ejected by the first ejection waveform element.

It is preferable that in a case where ½ of an acoustic resonance cycle of a pressure wave in the pressure chamber is denoted by AL, each of an interval of a plurality of drive pulses included in the second ejection waveform element and an interval of a plurality of drive pulses included in the third ejection waveform element is 2×AL. Accordingly, the liquid droplet can be efficiently ejected using a residual pressure.

It is preferable that the dot forming unit includes a pulse selection switch that selects and outputs a drive waveform supplied from the waveform supply unit for forming dots of at least three sizes, in a case where ½ of an acoustic resonance cycle of a pressure wave in the pressure chamber is denoted by AL, a first period from the end of output of the first ejection waveform element until the start of output of the second ejection waveform element or the third ejection waveform element is longer than or equal to a settling time of the pulse selection switch and shorter than or equal to AL, and in a case where the drive waveform for forming the dot of the small droplet is output, the pulse selection switch is set to be OFF in the first period. Accordingly, the amplitude of the second ejection waveform element or the third ejection waveform element can be increased.

It is preferable that the second ejection waveform element is the same waveform element as the first ejection waveform element. Accordingly, a time period from the start of ejection until landing of the liquid droplet ejected by the first ejection waveform element and the liquid droplet ejected by the second ejection waveform element can be set to be the same, and the landing position can be made uniform.

It is preferable that in the drive waveform for forming the dot of the medium droplet, an interval between the first ejection waveform element and the second ejection waveform element is ½ of the one drive cycle. Accordingly, the liquid droplet ejected by the second ejection waveform element can land at a position at the center between pixels, and high resolution can be achieved in the direction of relative movement. Here, ½ of the one drive cycle is a concept that is not limited to ½ of the one drive cycle in a strict sense and includes a deviation of ±10% of ½ of the one drive cycle.

The second ejection waveform element may include n waveform elements each being the same as the first ejection waveform element. In the drive waveform for forming the dot of the medium droplet, an interval between the first ejection waveform element and the second ejection waveform element may be 1/n of the one drive cycle. Accordingly, the landing position of the liquid droplet ejected by the second ejection waveform element can be set to be constant regardless of the characteristics of the liquid ejection head. Furthermore, high resolution can be achieved in the direction of relative movement. Here, 1/n of the one drive cycle is a concept that is not limited to 1/n of the one drive cycle in a strict sense and includes a deviation of ±10% of 1/n of the one drive cycle.

It is preferable that in a case where a distance from the nozzle to the recording medium is denoted by D, a droplet velocity of the liquid droplet ejected by the first ejection waveform element is denoted by $V_{MP}$, a droplet velocity of the liquid droplet ejected by the second ejection waveform element is denoted by $V_{MS}$, a time period of ejection based on the first ejection waveform element is denoted by $P_{MP}$, and a time period of ejection based on the second ejection waveform element is denoted by $P_{MS}$, an expression $D/V_{MP}(P_{LS}-P_{MP})<D/V_{MS}$ is established. Accordingly, it is possible not to combine the liquid droplet ejected by the first ejection waveform element and the liquid droplet ejected by the second ejection waveform element while reaching onto the recording medium.

It is preferable that in a case where a distance from the nozzle to the recording medium is denoted by D, a droplet velocity of the liquid droplet ejected by the first ejection waveform element is denoted by $V_{LP}$, a droplet velocity of the liquid droplet ejected by the third ejection waveform element is denoted by $V_{LS}$, a time period of ejection based on the first ejection waveform element is denoted by $P_{LP}$, and a time period of ejection based on the third ejection waveform element is denoted by $P_{LS}$ an expression $D/V_{LP}+(P_{LS}-P_{LP})D/V_{LS}$ is established. Accordingly, it is possible to combine the liquid droplet ejected by the first ejection waveform element and the liquid droplet ejected by the second ejection waveform element while reaching onto the recording medium.

It is preferable that the defect specifying unit specifies a non-ejection nozzle not ejecting the liquid droplet and a deflected ejection nozzle for which a landing position error of the ejected liquid droplet exceeds an allowed value among the plurality of nozzles. Accordingly, dots to be formed by the non-ejection nozzle and the deflected ejection nozzle can be appropriately complemented by ejection of the nozzle adjacent in the second direction.

An aspect of an image recording method for achieving the object comprises a dot forming step of forming a dot on a recording medium by ejecting a liquid droplet from a plurality of nozzles based on dot data while relatively moving a liquid ejection head and the recording medium in a first direction, the liquid ejection head including the plurality of nozzles ejecting the liquid droplet, a plurality of pressure chambers respectively communicating with the plurality of nozzles, and a plurality of liquid droplet ejection elements pressurizing liquid in the plurality of pressure chambers, respectively, depending on a supplied drive waveform, a waveform supply step of supplying a drive waveform for forming at least a dot of a small droplet, a dot of a medium droplet, or a dot of a large droplet of different sizes to the liquid ejection head depending on the dot data, the drive waveform including an ejection waveform element for ejecting the liquid droplet from the nozzle in one drive cycle, a defect specifying step of specifying a defective nozzle having an ejection malfunction among the plurality of nozzles, and a data acquisition step of acquiring the dot data which includes at least four gradations including the dot of the small droplet, the dot of the medium droplet, the dot of the large droplet, and no dot and complements a dot to be formed by ejection of the defective nozzle by the dot of the large droplet formed by ejection of a nozzle adjacent to the defective nozzle in at least a second direction intersecting the first direction. The drive waveform for forming the dot of the small droplet is a drive waveform for ejecting the liquid droplet by a first ejection waveform element arranged in a first half of the one drive cycle. The drive waveform for forming the dot of the medium droplet is a drive waveform for ejecting the liquid droplet by the first ejection waveform element and a second ejection waveform element arranged after the first ejection waveform element in time series, and the liquid droplet ejected by the first ejection waveform element and the liquid droplet ejected by the second ejection waveform element are not combined while reaching onto the recording medium and are combined on the recording medium. The drive waveform for forming the dot of the large droplet is a drive waveform for ejecting the liquid droplet by the first ejection waveform element and a third ejection waveform element that is arranged after the first ejection waveform element in time series and includes at least a part of the second ejection waveform element, and the liquid droplet ejected by the first ejection waveform element and the liquid droplet ejected by the third ejection waveform element are combined while reaching onto the recording medium.

According to the present aspect, for the small droplet, the liquid droplet is ejected by the first ejection waveform element arranged in the first half of the one drive cycle. For the medium droplet, the liquid droplet is ejected by the first ejection waveform element and the second ejection waveform element arranged after the first ejection waveform element in time series. The liquid droplet ejected by the first ejection waveform element and the liquid droplet ejected by the second ejection waveform element are not combined while reaching onto the recording medium and are combined on the recording medium. Thus, the landing positions of the dot of the small droplet and the dot of the medium droplet can be matched.

In addition, the present aspect includes a program causing a computer to execute each step of the image recording method, and a computer-readable non-transitory recording medium on which the program is recorded.

According to the present invention, the landing positions of droplet types can be matched in the consecutive ejection drive method.

DESCRIPTION OF THE PREFERRED EMBODIMENTS

Hereinafter, an exemplary embodiment of the present embodiment will be described in detail in accordance with the appended drawings.

<Overall Configuration of Ink Jet Recording Device>

Figure 1:
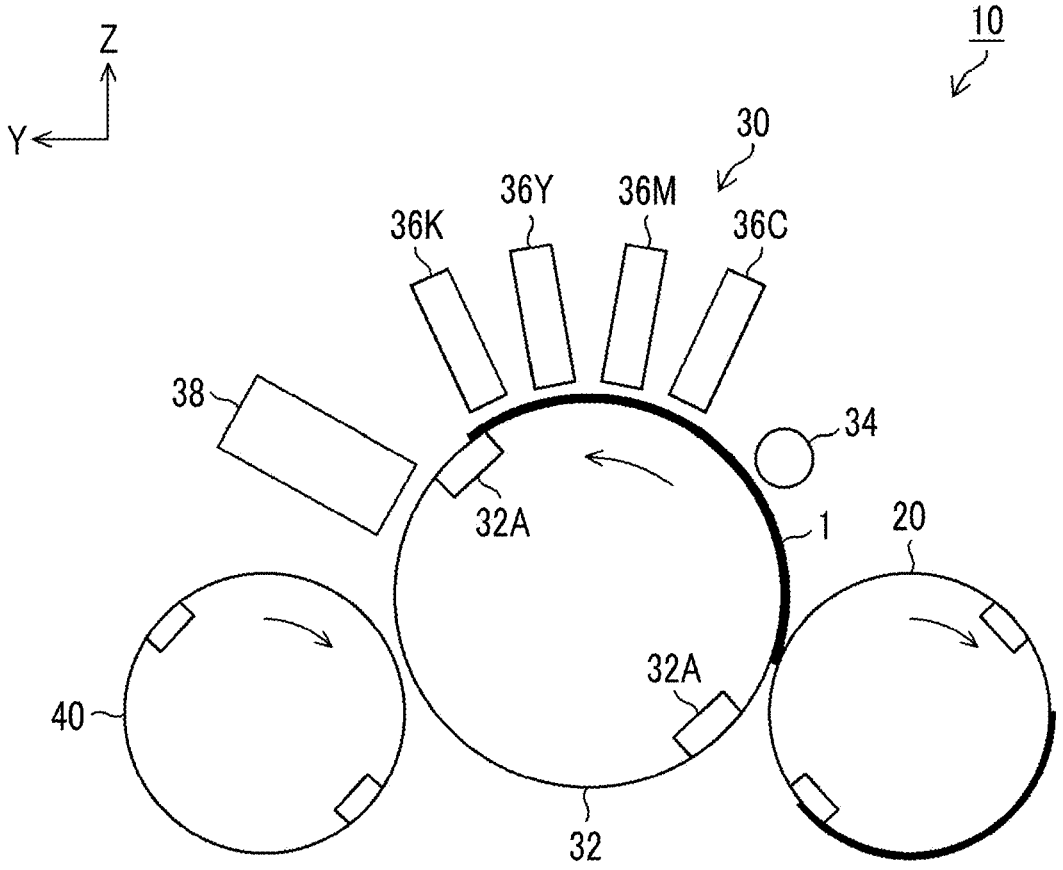
FIG. 1 is an overall configuration diagram illustrating one embodiment of an ink jet recording device.

FIG. 1 is an overall configuration diagram illustrating one embodiment of an ink jet recording device. An ink jet recording device 10 (one example of an image recording device) is a sheet-fed type aqueous ink jet printer printing an image on a paper 1 (one example of a recording medium) using aqueous ink (one example of liquid) based on an ink jet method. As illustrated in FIG. 1, the ink jet recording device 10 is mainly configured to comprise a transport drum 20 that transports the fed paper 1, an image recording unit 30 that prints the image on a recording surface (one example of the recording medium) of the paper 1 received from the transport drum 20 using the aqueous ink based on the ink jet method, and a transport drum 40 that transports the paper 1 on which the image is printed by the image recording unit 30.

The image recording unit 30 prints a color image by providing an ink droplet that is a liquid droplet of ink of each color on the recording surface of the paper 1 while transporting the paper 1. The image recording unit 30 is configured to comprise an image recording drum 32 that transports the paper 1, a paper pressing roller 34 that presses the paper transported by the image recording drum 32 and causes the paper 1 to firmly stick to the circumferential surface of the image recording drum 32, ink jet heads (one example of a liquid ejection head; hereinafter, simply referred to as heads) 36C, 36M, 36Y, and 36K that eject ink droplets of colors of cyan (C), magenta (M), yellow (Y), and black (K) to the paper 1, an imaging unit 38 that reads the image printed on the paper 1, and the like.

The image recording drum 32 is a transport means for the paper 1 in the image recording unit 30. The image recording drum 32 is formed in a cylindrical shape and rotates about the center of the cylinder as an axis by driving the image recording drum 32 by a motor, not illustrated. A gripper 32A is comprised on the outer circumferential surface of the image recording drum 32. The distal end of the paper 1 is held by the gripper 32A. The image recording drum 32 transports the paper 1 while winding the paper 1 on its circumferential surface by rotating with the distal end of the paper 1 held by the gripper 32A.

In addition, multiple suction holes, not illustrated, are formed in a predetermined pattern on the outer circumferential surface of the image recording drum 32. The paper 1 wound on the circumferential surface of the image recording drum 32 is transported while being adhesively held on the circumferential surface of the image recording drum 32 by suction from the suction holes. Accordingly, the paper 1 can be highly smoothly transported. A mechanism that adhesively holds the paper 1 on the circumferential surface of the image recording drum 32 is not limited to an adhesion method based on a negative pressure. A method based on electrostatic adhesion can be employed.

In addition, the gripper 32A is disposed at two locations on the outer circumferential surface of the image recording drum 32 and is configured to enable two sheets of the paper 1 to be transported with one rotation of the image recording drum 32. The rotation of the transport drum 20 and the image recording drum 32 is controlled to match their timings of reception and handover of the paper 1. Similarly, the rotation of the image recording drum 32 and the transport drum 40 is controlled to match their timings of reception and handover of the paper 1. That is, the transport drum 20, the image recording drum 32, and the transport drum 40 are driven to have the same circumferential velocity and are driven such that the position of the gripper matches therebetween.

The paper pressing roller 34 is disposed near a paper reception position of the image recording drum 32. The paper pressing roller 34 is configured with a rubber roller and is installed in a pressed and abutting manner to the circumferential surface of the image recording drum 32. The paper 1 handed over to the image recording drum 32 from the transport drum 20 is nipped by passing through the paper pressing roller 34 and filmy sticks to the circumferential surface of the image recording drum 32.

Each of the heads 36C, 36M, 36Y, and 36K is configured with a line head corresponding to a paper width and is arranged at a constant interval along a path of transport of the paper 1 by the image recording drum 32 such that a nozzle surface 50A (refer to FIG. 4) faces the outer circumferential surface of the image recording drum 32. Each of the heads 36C, 36M, 36Y, and 36K records the image on the recording surface of the paper 1 transported by the image recording drum 32 by ejecting ink droplets toward the image recording drum 32 from a plurality of nozzles 51 (refer to FIG. 2) formed on the nozzle surface 50A.

The imaging unit 38 is imaging means for imaging the image printed on the recording surface of the paper 1 by the heads 36C, 36M, 36Y, and 36K and is installed on the downstream side of the rearmost head 36K in a direction of transport of the paper 1 by the image recording drum 32. The imaging unit 38 includes a line sensor including a solid-state imaging element such as a charge-coupled device (CCD) or a complementary metal oxide semiconductor (CMOS) and an imaging optical system having a fixed focal point.

The image recording unit 30 configured as described above receives the paper transported by the transport drum 20 using the image recording drum 32. The image recording drum 32 transports the paper 1 by rotating with the distal end of the paper 1 held by the gripper 32A. The paper pressing roller 34 causes the paper 1 to firmly stick to the circumferential surface of the image recording drum 32. In the meantime, the image recording drum 32 suctions the paper 1 from the suction hole and adhesively holds the paper 1 on the outer circumferential surface of the image recording drum 32.

The heads 36C, 36M, 36Y, and 36K record a color image on the recording surface by respectively providing ink droplets of colors of cyan, magenta, yellow, and black to the recording surface of the paper 1 in a case where the paper 1 passes through positions facing the heads 36C, 36M, 36Y, and 36K.

The imaging unit 38 reads the image printed on the recording surface of the paper 1 in a case where the paper 1 passes through a position facing the imaging unit 38. The reading of the printed image is performed as needed, and inspection is performed for a defective nozzle such as a nozzle having an ejection defect and/or a deflected ejection nozzle causing an image defect by detecting an image defect such as a streak from the read image. In the case of performing the reading, the reading is performed in a state where the paper 1 is adhesively held on the image recording drum 32. Thus, the reading can be performed with high accuracy. In addition, since the reading is performed immediately after printing, a malfunction such as a nozzle having an ejection defect and/or a deflected ejection nozzle can be immediately detected and can be promptly dealt with. Accordingly, useless printing can be prevented, and the occurrence of paper loss can be reduced as far as possible.

Then, the image recording drum 32 hands the paper 1 over to the transport drum 40.

<Structure of Ink Jet Head>

Next, the structure of the ink jet head will be described. The heads 36C, 36M, 36Y, and 36K corresponding to each color have the same structure. Thus, hereinafter, the head will be designated by reference sign 36 as a representative.

Figure 2:
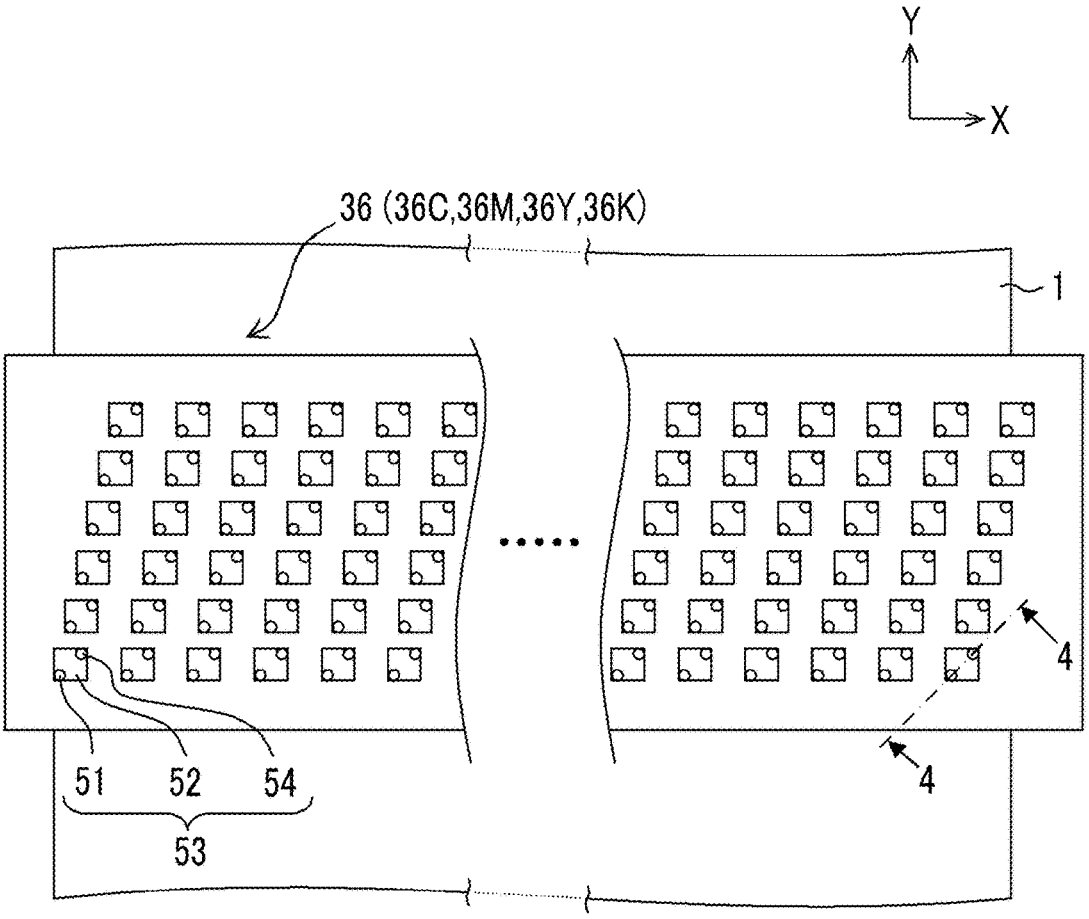
FIG. 2 is a perspective plan view illustrating an example of the structure of a head.
Figure 3:
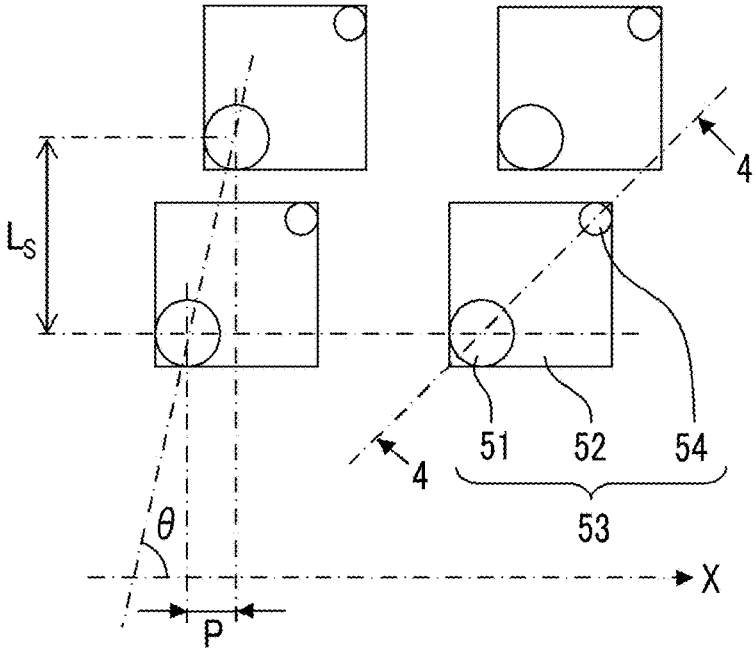
FIG. 3 is an enlarged view of a part of FIG. 2.

FIG. 2 is a perspective plan view illustrating an example of the structure of the head 36, and FIG. 3 is an enlarged view of a part of FIG. 2. As illustrated in FIG. 2, the head 36 has a structure in which a plurality of ink chamber units 53 each including the nozzle 51 ejecting an ink droplet and a plurality of pressure chambers 52 communicating with the nozzle 51 are 2-dimensionally arranged in a matrix form. Accordingly, high density is achieved for substantial nozzle intervals that are projected (orthographically projected) to be linearly arranged in a direction (X direction; one example of a second direction) orthogonal (one example of intersecting) to the transport direction (Y direction; one example of a first direction) of the paper 1.

The plan view shape of the pressure chamber 52 disposed in correspondence with each nozzle 51 is approximately a square. A flow outlet to the nozzle 51 is disposed in one of both corner portions on a diagonal, and an ink supply port 54 is disposed in the other.

Figure 4:
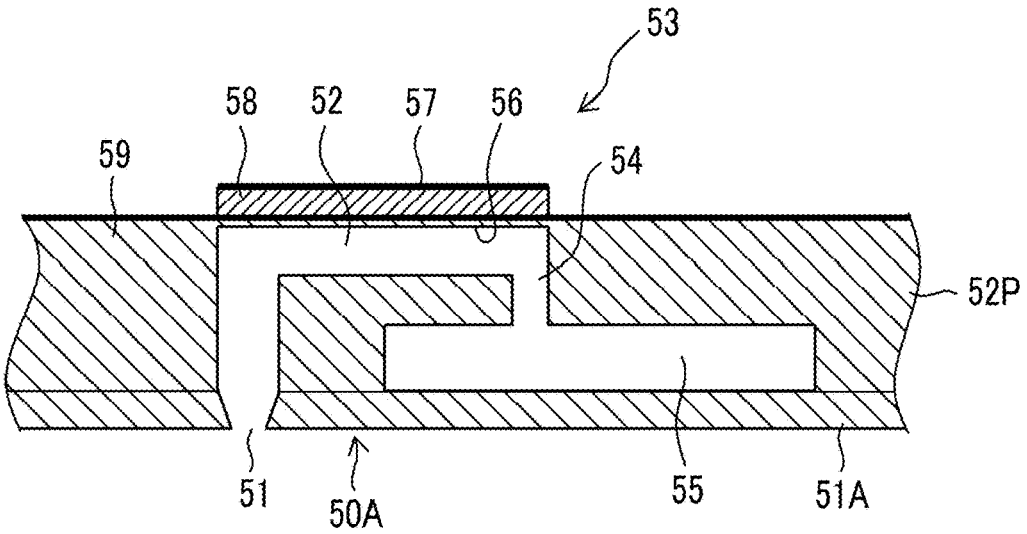
FIG. 4 is a 4-4 cross-sectional view of FIG. 2.

FIG. 4 is a 4-4 cross-sectional view of FIG. 2. As illustrated in FIG. 4, the head 36 has a structure in which a nozzle plate 51A, a flow channel plate 52P, and the like are bonded as a lamination layer. The nozzle 51 is formed in the nozzle plate 51A. The pressure chamber 52 and a flow channel such as a common flow channel 55 are formed in the flow channel plate 52P. The nozzle plate MA constitutes the nozzle surface 50A of the head 36. The plurality of nozzles 51 each communicating with the pressure chamber 52 are 2-dimensionally formed in the nozzle plate 51A.

The flow channel plate 52P is a flow channel forming member that constitutes a side wall portion of the pressure chamber 52 and forms the supply port 54 as a narrowed portion (most narrowed portion) of an individual supply channel guiding ink to the pressure chamber 52 from the common flow channel 55. While the flow channel plate 52P is schematically illustrated in FIG. 4 for convenience of description, the flow channel plate 52P has a structure in which one or a plurality of substrates are laminated.

The nozzle plate 51A and the flow channel plate 52P can be processed to have a necessary shape by a semiconductor manufacturing process using silicon as a material.

The common flow channel 55 communicates with an ink tank (not illustrated) as an ink supply source, and ink supplied from the ink tank is supplied to each pressure chamber 52 through the common flow channel 55.

A piezo actuator 58 comprising an individual electrode 57 is bonded to a vibration plate 56 constituting a part of the surfaces (in FIG. 4, the upper surface) of the pressure chamber 52. The vibration plate 56 includes silicon with a nickel conductive layer functioning as a common electrode 59 corresponding to a lower electrode of the piezo actuator 58. The vibration plate 56 doubles as a common electrode of the piezo actuator 58 arranged in correspondence with each pressure chamber 52. In an aspect, the vibration plate can also be formed using a non-conductive material such as resin. In this case, a common electrode layer based on a conductive material such as metal is formed on the surface of the vibration plate member. In addition, a vibration plate that doubles as a common electrode based on metal such as stainless steel may be configured.

By applying a drive waveform to the individual electrode 57, the piezo actuator 58 (one example of a liquid droplet ejection element) deforms, and the capacity of the pressure chamber 52 changes. The change in capacity pressurizes ink inside the pressure chamber 52, and ink is ejected from the nozzle 51. After ink is ejected, the pressure chamber 52 is filled with new ink again from the common flow channel 55 through the supply port 54 in a case where the piezo actuator 58 returns to its original state.

The high density nozzle head of the present example is implemented by arranging multiple ink chamber units 53 having the above structure in a lattice form in a certain arrangement pattern in a row direction corresponding to a main scanning direction and an inclined column direction that has a certain angle θ and is not orthogonal with respect to the main scanning direction as illustrated in FIG. 2. In a case where an adjacent nozzle interval in the Y direction is denoted by $L_S$, such a matrix arrangement can be considered to be substantially equivalent to linear arrangement of the nozzles 51 at a certain pitch $P=L_S/\tan 0$ in the main scanning direction.

Figure 5:
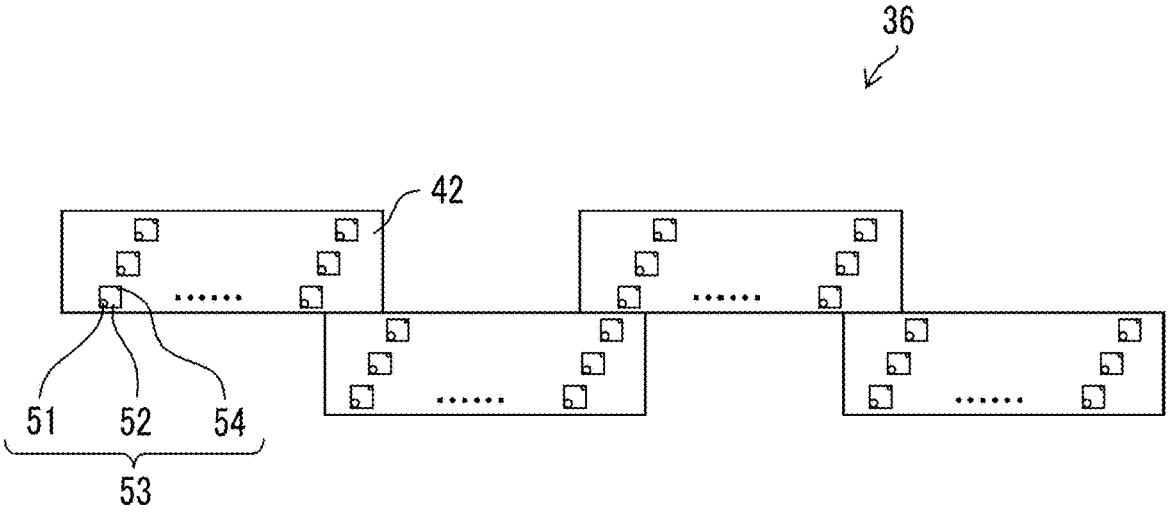
FIG. 5 is a perspective plan view illustrating another example of the structure of the head.
Figure 6:
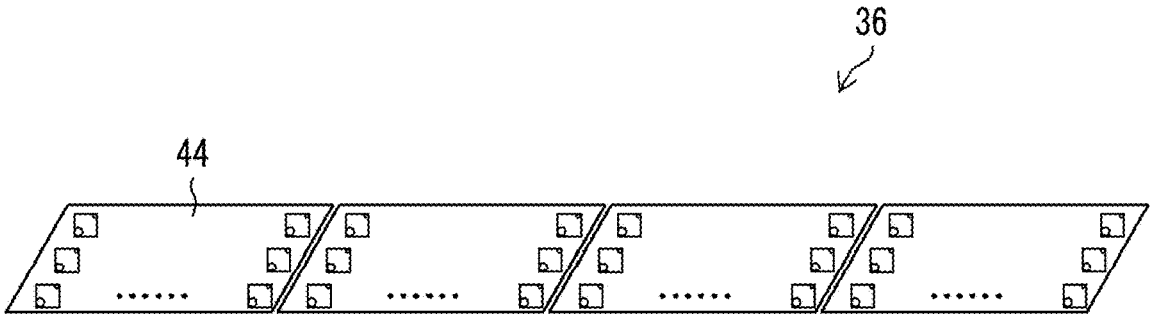
FIG. 6 is a perspective plan view illustrating another example of the structure of the head.

In an aspect, instead of the configuration illustrated in FIG. 2, the head 36 can have a configuration in which a short head module 42 in which a plurality of nozzles 51 are 2-dimensionally arranged and linked is arranged in a zigzag form as illustrated in FIG. 5, or a configuration in which a head module 44 is linearly arranged and linked in a row as illustrated in FIG. 6.

In addition, the arrangement of the nozzles 51 in the head 36 is not limited, and various nozzle arrangement structures can be applied. For example, instead of the matrix arrangement described in FIG. 2, a V shape nozzle arrangement or a folded line shape nozzle arrangement such as a W shape having the V shape arrangement as a repeating unit can be used.

Furthermore, means for generating a pressure for ejection (ejection energy) for ejecting a liquid droplet from each nozzle in the head 36 is not limited to the piezo actuator (piezoelectric element). A heater (heating element) in a thermal method (a method of ejecting ink using the pressure of film boiling caused by heating of the heater) or various pressure generation elements (energy generation elements) such as various actuators in other methods may be applied. Depending on the ejection method for the head 36, a corresponding energy generation element is disposed in a flow channel structure.

<Configuration of Control System>

Figure 7:
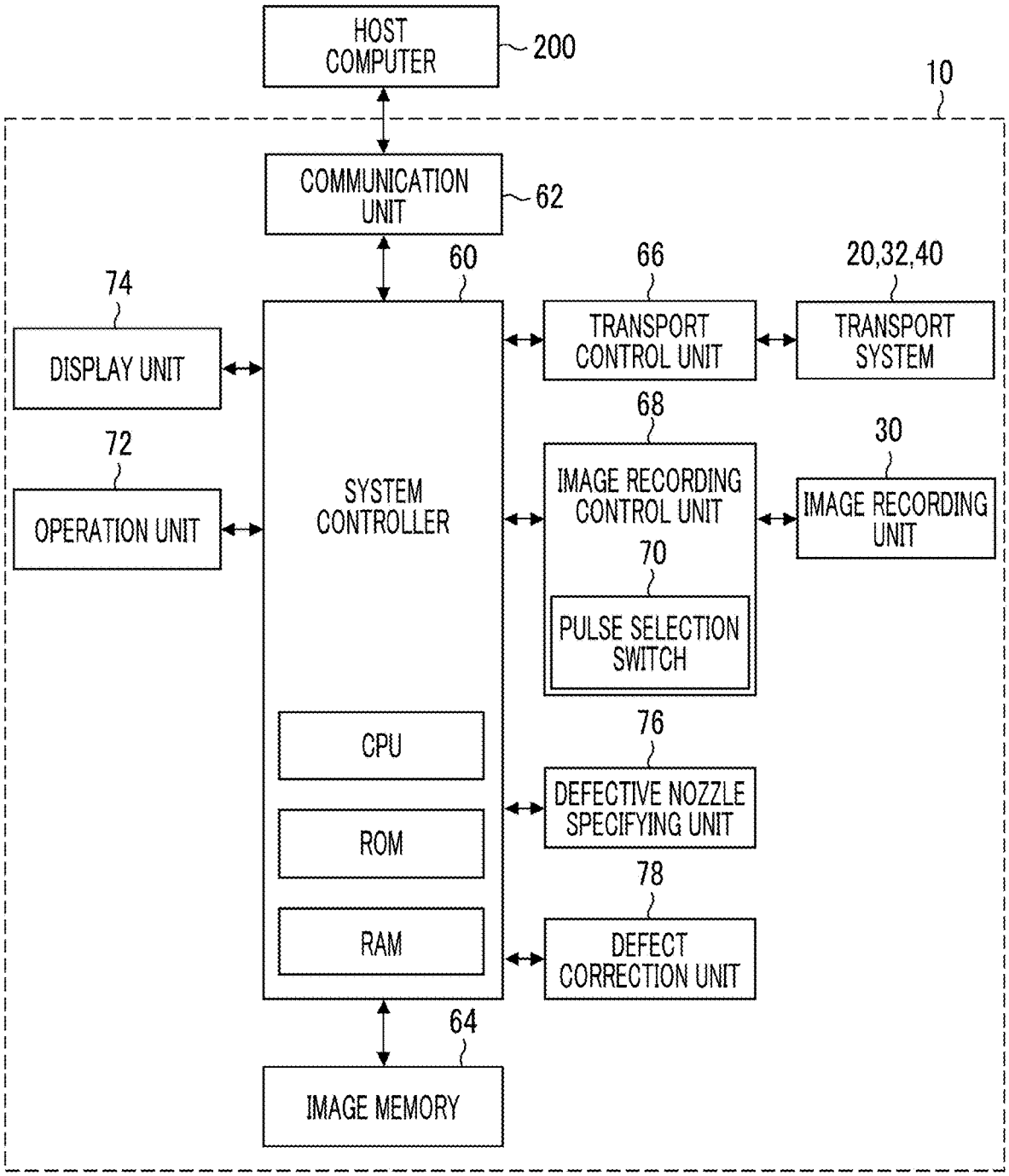
FIG. 7 is a block diagram illustrating a schematic configuration of a control system of the ink jet recording device.

FIG. 7 is a block diagram illustrating a schematic configuration of a control system of the ink jet recording device 10. As illustrated in FIG. 7, the ink jet recording device 10 comprises a system controller 60, a communication unit 62, an image memory 64, a transport control unit 66, an image recording control unit 68, an operation unit 72, a display unit 74, a defective nozzle specifying unit 76, a defect correction unit 78, and the like.

The system controller 60 functions as control means for managing and controlling each unit of the ink jet recording device 10 and also functions as calculation means for performing various calculation processes. The system controller 60 comprises a central processing unit (CPU), a read only memory (ROM), a random access memory (RAM), and the like and operates in accordance with a predetermined control program. The ROM stores the control program executed by the system controller 60 and various data necessary for control.

The communication unit 62 comprises a necessary communication interface and transmits and receives data with a host computer 200 connected to the communication interface.

The image memory 64 functions as temporary storage means for various data including image data, and data is read and written through the system controller 60. The image data acquired from the host computer 200 through the communication unit 62 is stored in the image memory 64.

The transport control unit 66 controls driving of the transport drum 20, the image recording drum 32, and the transport drum 40 that are a transport system for the paper 1 in the ink jet recording device 10. The transport control unit 66 controls the transport system in response to an instruction from the system controller 60 and smoothly transports the paper 1.

The image recording control unit 68 generates a drive waveform corresponding to dot data and applies (supplies) the drive waveform to the individual electrode 57 of each piezo actuator 58.

The image recording control unit 68 comprises a pulse selection switch 70 for selecting the drive waveform to be applied to the individual electrode 57 from drive waveforms $W_S$, $W_M$, and $W_L$, described below, for forming dots of three sizes and a drive waveform for no output.

The image recording control unit 68 (one example of a waveform supply unit; one example of a dot forming unit) selects the generated drive waveform by the pulse selection switch 70 in response to an instruction from the system controller 60 such that an image based on the dot data is printed on the paper 1 transported by the image recording drum 32, and supplies the selected drive waveform to the heads 36C, 36M, 36Y, and 36K (refer to FIG. 1) (one example of a waveform supply step). Accordingly, an ink droplet is ejected from each nozzle 51 of the heads 36C, 36M, 36Y, and 36K, and a dot is formed on the paper 1 (one example of a dot forming step).

The operation unit 72 is input means comprising an operation button, a keyboard, a touch panel, and the like. A user can input a print job for the ink jet recording device 10 by the operation unit 72. The print job refers to one set of process units to be printed based on the image data. The operation unit 72 outputs the input print job to the system controller 60, and the system controller 60 executes various processes depending on the print job input from the operation unit 72.

The display unit 74 comprises a display device such as a liquid crystal display (LCD) panel and displays necessary information on the display device in response to an instruction from the system controller 60.

The defective nozzle specifying unit 76 (one example of a defect specifying unit) specifies the nozzle 51 that is a defective nozzle having an ejection malfunction (one example of a defect specifying step). The defective nozzle specifying unit 76 prints a test pattern for defective nozzle detection on the paper 1 by the heads 36C, 36M, 36Y, and 36K based on data of the test pattern for defective nozzle detection stored in advance. The printed test pattern is read by the imaging unit 38, and a defective nozzle is specified from the plurality of nozzles 51 of the heads 36C, 36M, 36Y, and 36K by analyzing the reading result of the imaging unit 38.

In the present embodiment, a non-ejection nozzle from which ink is not ejected at all, and a deflected ejection nozzle for which a landing position error for ejected ink exceeds an allowed value are specified as the defective nozzle. The defective nozzle specifying unit 76 stores the specified defective nozzle in a storage unit, not illustrated.

The defect correction unit 78 (one example of a data acquisition unit) corrects the dot data such that a dot to be formed by ejection of the defective nozzle specified by the defective nozzle specifying unit 76 is complemented by a dot formed by ejection of the nozzle 51 adjacent to the defective nozzle in at least the X direction (one example of a data acquisition step).

Figure 8:
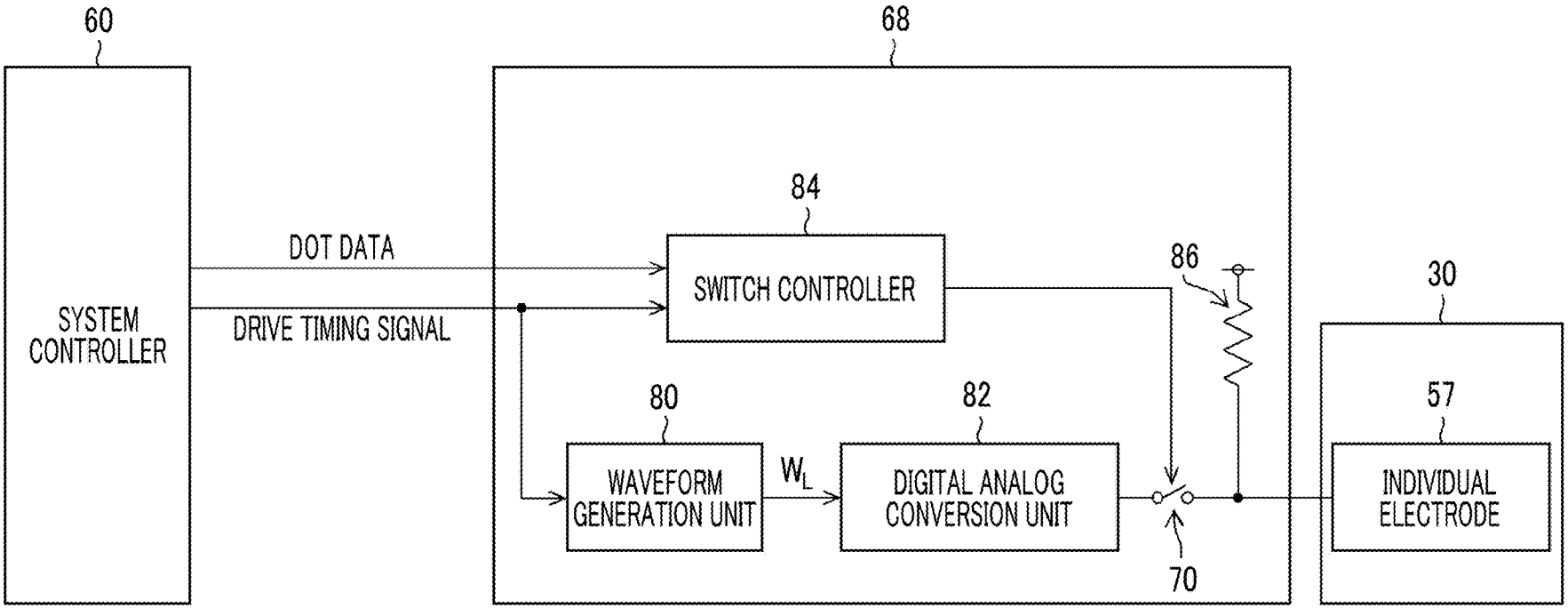
FIG. 8 is a block diagram illustrating the inside of an image recording control unit.

FIG. 8 is a block diagram illustrating the inside of the image recording control unit 68 and illustrates a part corresponding to one individual electrode 57. As illustrated in FIG. 8, the image recording control unit 68 comprises a waveform generation unit 80, a digital analog conversion unit 82, a switch controller 84, a bias resistor 86, and the like in addition to the pulse selection switch 70.

The waveform generation unit 80 generates the drive waveform $W_L$ that is a reference drive waveform, in synchronization with a drive timing signal input from the system controller 60. The digital analog conversion unit 82 converts the input drive waveform $W_L$ that is a digital signal into an analog signal and outputs the analog signal. The output of the digital analog conversion unit 82 is input into one end of the pulse selection switch 70.

One end of the pulse selection switch 70 is connected to the output of the digital analog conversion unit 82, and another end is connected to the individual electrode 57 of the corresponding piezo actuator 58 (refer to FIG. 4). In addition, one terminal of the bias resistor 86 is connected to the individual electrode, and another terminal of the bias resistor 86 is connected to a bias voltage of the drive waveform.

The switch controller 84 controls the pulse selection switch 70 to be ON and OFF in synchronization with the drive timing signal input from the system controller 60 based on the dot data input from the system controller 60.

The pulse selection switch 70 is controlled to be ON and OFF by the switch controller 84. In a case where the pulse selection switch 70 is ON, the analog drive waveform output from the digital analog conversion unit 82 is input into the individual electrode 57. In a case where the pulse selection switch 70 is OFF, the input of the individual electrode 57 is fixed (latched) to the bias voltage.

The control system of the ink jet recording device 10 configured in the above manner acquires the image data to be printed on the paper 1 in the ink jet recording device 10 from the host computer 200 through the communication unit 62. The acquired image data is stored in the image memory 64.

The system controller 60 generates the dot data corresponding to each nozzle 51 by performing necessary signal processing on the image data stored in the image memory 64. The image recording control unit 68 controls driving of each of the heads 36C, 36M, 36Y, and 36K of the image recording unit 30 in accordance with the generated dot data and prints the image represented by the image data on the recording surface of the paper 1.

The dot data is data having four gradations including a dot of a small droplet that is a relatively light and small droplet, a dot of a medium droplet that is a relatively deep and large droplet, a dot of a large droplet that is a droplet deeper and larger than the dot of the medium droplet, and no dot. Generally, the dot data is generated by performing a color conversion process and a halftone process on the image data. The color conversion process is a process of converting the image data represented by standard red green blue (sRGB) or the like into ink amount data for each color of ink used in the ink jet recording device 10. In the present embodiment, the image data is converted into ink amount data for each color of C, M, Y, and K. The halftone process is a process of converting the ink amount data for each color generated by the color conversion process into dot data for each color by performing a process such as error diffusion on the ink amount data.

In a case where the defective nozzle specified by the defective nozzle specifying unit 76 is present, the dot data is corrected depending on the defective nozzle by the defect correction unit 78. The image data may be corrected first depending on the defective nozzle, and the dot data may be generated by performing the color conversion process and the halftone process based on the corrected image data.

In the present embodiment, in a case where the defective nozzle is not present, data having three gradations including the dot of the small droplet, the dot of the medium droplet, and no dot is generated as the dot data. In addition, in a case where the defective nozzle is present, the dot to be formed by ejection of the defective nozzle is complemented by the dot of the large droplet formed by ejection of the nozzle 51 adjacent to the defective nozzle in the X direction. The dot data having four gradations including the dot of the small droplet, the dot of the medium droplet, the dot of the large droplet, and no dot may be generated in a case where the defective nozzle is not present. The dot to be formed by ejection of the defective nozzle may be complemented by the dot of the medium droplet and/or the dot of the small droplet formed by ejection of the nozzle 51 adjacent to the defective nozzle in the X direction.

The system controller 60 prints the image represented by the image data on the paper 1 by controlling driving of the corresponding head 36 in accordance with the dot data for each color generated in the above manner.

<Description of Deviation Between Landing Positions of Small Droplet and Medium Droplet>

Figure 9:
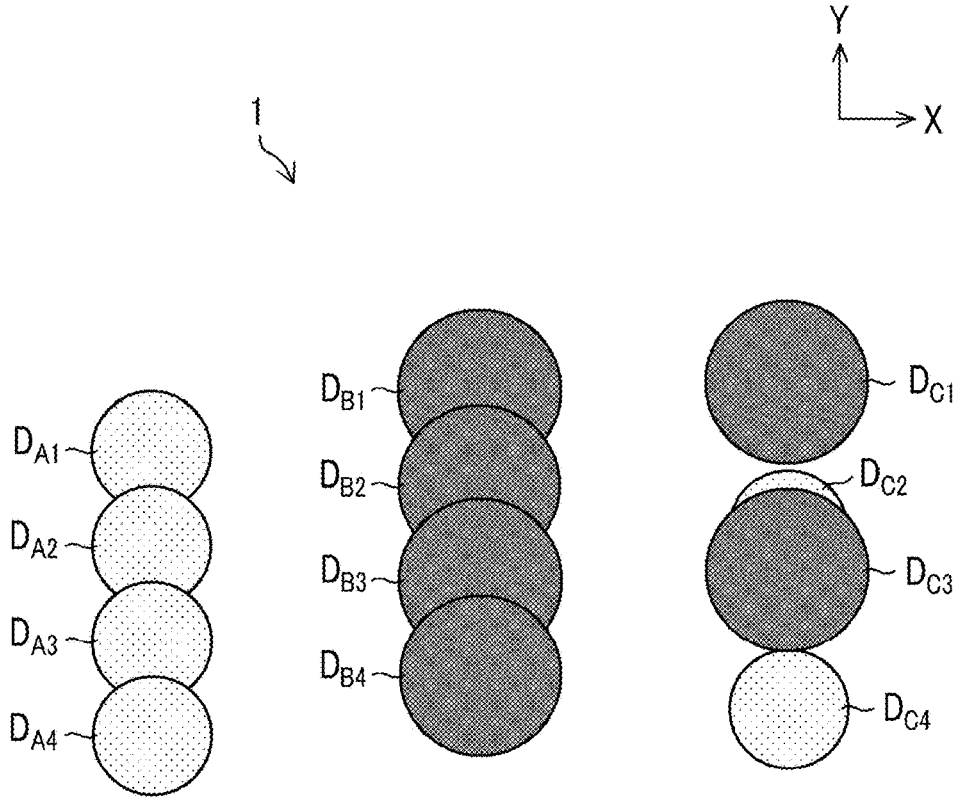
FIG. 9 is a diagram illustrating one example of a landing state of a dot of a small droplet and a dot of a medium droplet.
Figure 10:
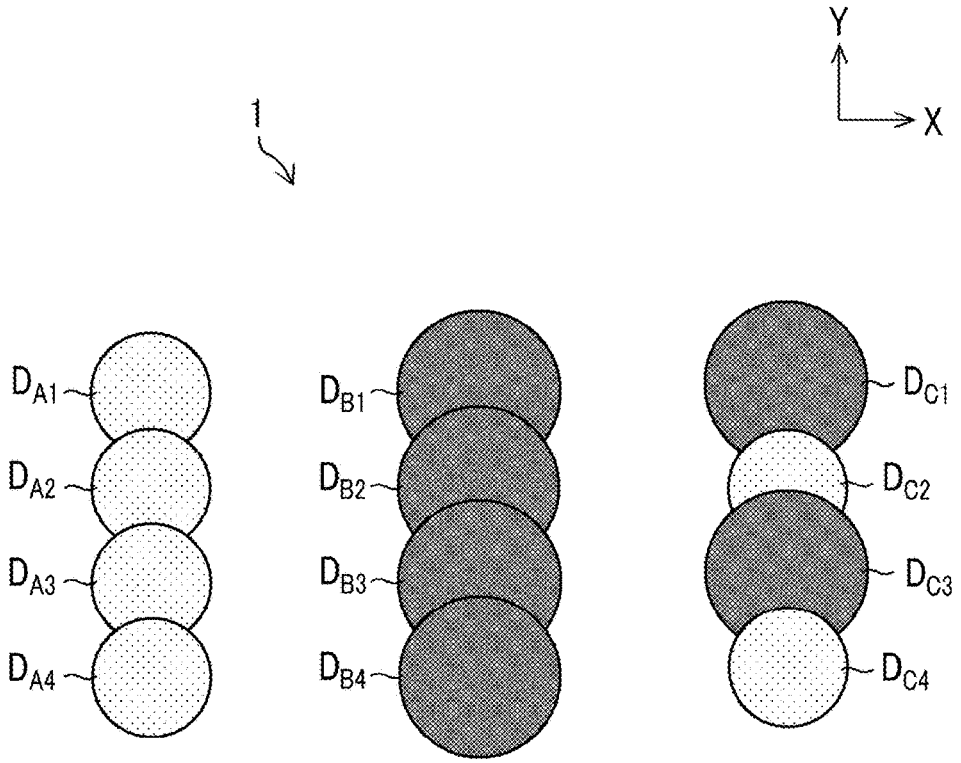
FIG. 10 is a diagram illustrating one example of the landing state of the dot of the small droplet and the dot of the medium droplet.
Figure 11:
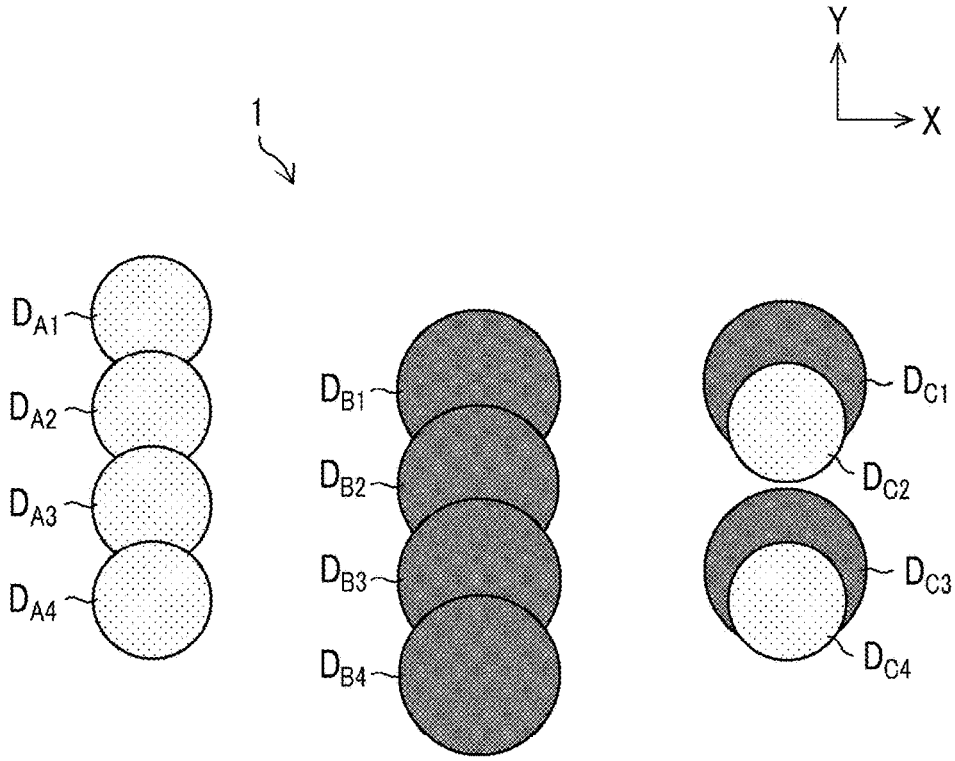
FIG. 11 is a diagram illustrating one example of the landing state of the dot of the small droplet and the dot of the medium droplet.

FIG. 9 to FIG. 11 are diagrams illustrating one example of a landing state of the dot of the small droplet that is a relatively light and small droplet, and the dot of the medium droplet that is a relatively deep and large droplet in the paper 1. FIG. 9 illustrates a case where the landing timing of the dot of the small droplet in the drive cycle is relatively late. FIG. 10 illustrates a case where the landing timing of the dot of the small droplet and the landing timing of the dot of the medium droplet are appropriate. FIG. 11 illustrates a case where the landing timing of the dot of the small droplet in the drive cycle is relatively early.

In FIG. 9 to FIG. 11, dots $D_{A1}$ to $D_{A4}$ are dots of the small droplets formed by a nozzle A. Dots $D_{B1}$ to $D_{B4}$ are dots of the medium droplets formed by a nozzle B. Dots $D_{C1}$ and $D_{C3}$ are dots of the medium droplets formed by a nozzle C. Dots $D_{C2}$ and $D_{C4}$ are dots of the small droplets formed by the nozzle C. In addition, the dots $D_{A1}$, $D_{B1}$, and $D_{C1}$ are dots of which the centers are to be arranged at the same position in the Y direction. Similarly, the dots $D_{A2}$, $D_{B2}$, and $D_{C2}$, the dots $D_{A3}$, $D_{B3}$, and $D_{C3}$, and the dots $D_{A4}$, $D_{B4}$, and $D_{C4}$ are dots of which the centers are to be arranged at the same position in the Y direction.

As illustrated in FIG. 10, in a case where the landing timing of the dot of the small droplet and the landing timing of the dot of the medium droplet are appropriate, the dots $D_{A1}$, $D_{B1}$, and $D_{C1}$, the dots $D_{A2}$, $D_{B2}$, and $D_{C2}$, the dots $D_{A3}$, $D_{B3}$, and $D_{C3}$, and the dots $D_{A4}$, $D_{B4}$, and $D_{C4}$ are arranged with their centers at the same position in the Y direction.

As illustrated in FIG. 9 and FIG. 11, in a case where the landing timing of the dot of the small droplet is different from the landing timing of the dot of the medium droplet, the dot $D_{A1}$ and the dot $D_{B1}$, the dot $D_{A2}$ and the dot $D_{B2}$, the dot $D_{A3}$ and the dot $D_{B3}$, the dot $D_{A4}$ and the dot $D_{B4}$, the dot $D_{B2}$ and the dot $D_{C2}$, and the dot $D_{B4}$ and the dot $D_{C4}$ are arranged with their positions in the Y direction deviating from each other.

As described using FIG. 2 and FIG. 3, each nozzle 51 is 2-dimensionally arranged in a matrix form, and the arrangements of the nozzle A, the nozzle B, and the nozzle C forming the dots illustrated in FIG. 9 to FIG. 11 are different in the Y direction.

That is, the dot $D_{A1}$ formed by the nozzle A, the dot $D_{B1}$ formed by the nozzle B, and the dot $D_{C1}$ formed by the nozzle C are formed in order from the nozzle 51 arranged on the upstream side in the transport direction of the paper 1 among the nozzle A, the nozzle B, and the nozzle C. While the dots $D_{A1}$, $D_{B1}$, and $D_{C1}$ are dots of which the centers are to be arranged at the same position in the Y direction, the nozzle A, the nozzle B, and the nozzle C do not perform ejection at the same time.

In the description of the present embodiment, the meaning of "the landing timing of the small droplet is relatively late" is that an elapsed time period from time 0 for the landing timing of the small droplet is relatively longer than that for the landing timing of the medium droplet as a result of comparing the landing timing of the small droplet with the landing timing of the medium droplet in one drive cycle starting from time 0 without considering the arrangement position of the nozzle 51 in the Y direction. That is, in a case where it is assumed that the dot of the small droplet and the dot of the medium droplet are ejected in the same drive cycle, the landing timing of the small droplet is later than the landing timing of the medium droplet.

Figure 12:
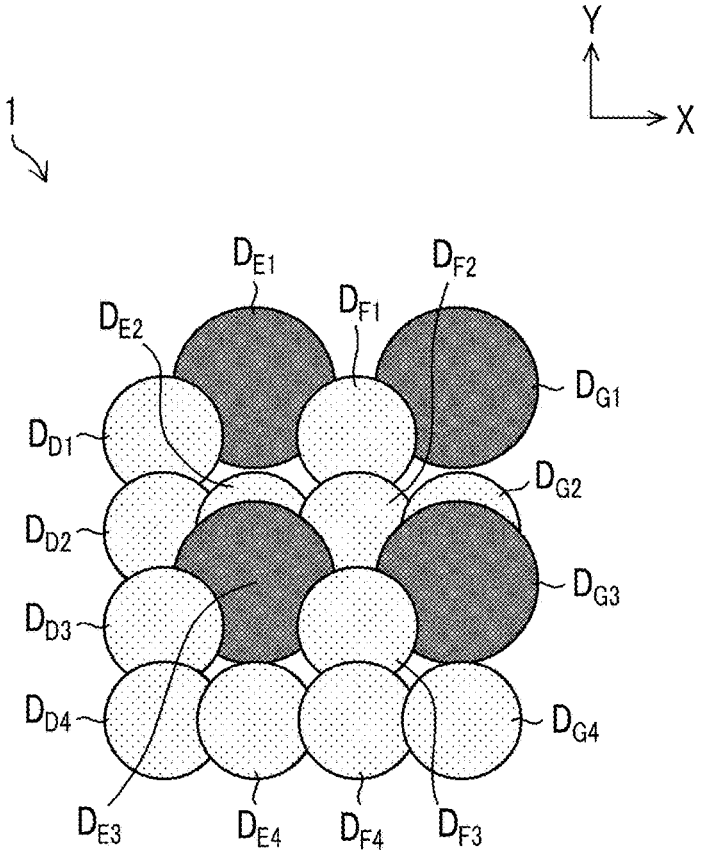
FIG. 12 is a diagram illustrating a solid portion formed using the dot of the small droplet and the dot of the medium droplet.
Figure 13:
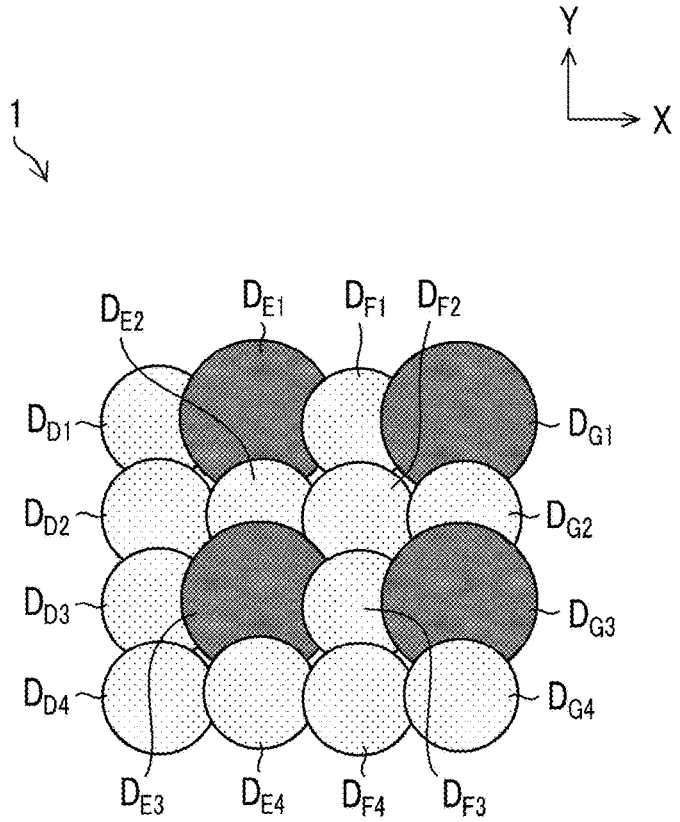
FIG. 13 is a diagram illustrating a solid portion formed using the dot of the small droplet and the dot of the medium droplet.
Figure 14:
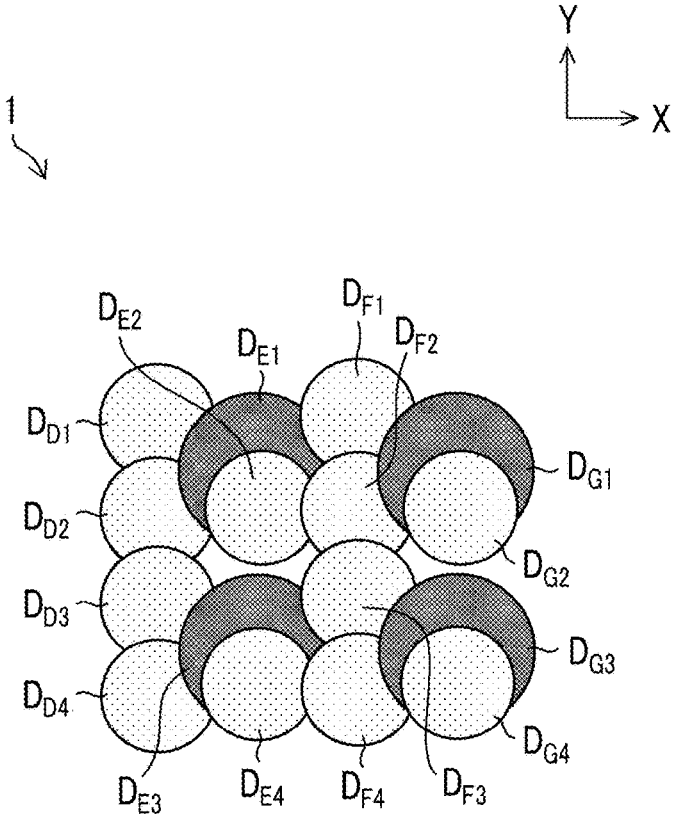
FIG. 14 is a diagram illustrating a solid portion formed using the dot of the small droplet and the dot of the medium droplet.

FIG. 12 to FIG. 14 are diagrams schematically illustrating a solid portion that is a region having a certain density or higher and formed on the paper 1 using the dot of the small droplet and the dot of the medium droplet. FIG. 12 illustrates a case where the landing timing of the dot of the small droplet in the drive cycle is relatively late. FIG. 13 illustrates a case where the landing timing of the dot of the small droplet and the landing timing of the dot of the medium droplet are appropriate. FIG. 14 illustrates a case where the landing timing of the dot of the small droplet in the drive cycle is relatively early.

In FIG. 12 to FIG. 14, dots $D_{D1}$ to $D_{D4}$ are dots of the small droplets formed by a nozzle D. Dots $D_{E1}$ and $D_{E3}$ are dots of the medium droplets formed by a nozzle E. Dots $D_{E2}$ and $D_{E4}$ are dots of the small droplets formed by the nozzle E. Dots $D_{F1}$ to $D_{F4}$ are dots of the small droplets formed by a nozzle F. Dots $D_{G1}$ and $D_{G3}$ are dots of the medium droplets formed by a nozzle G. Dots $D_{G2}$ and $D_{G4}$ are dots of the small droplets formed by the nozzle G. In addition, the dots $D_{D1}$, $D_{E1}$, $D_{F1}$, and $D_{G1}$ are dots of which the centers are to be arranged at the same position in the Y direction. Similarly, the dots $D_{D2}$, $D_{E2}$, $D_{F2}$, and $D_{G2}$, the dots $D_{D3}$, $D_{E3}$, $D_{F3}$, and $D_{G3}$, and the dots $D_{D4}$, $D_{E4}$, $D_{F4}$, and $D_{G4}$ are dots of which the centers are to be arranged at the same position in the Y direction.

As illustrated in FIG. 12 and FIG. 14, in a case where the landing timing of the dot of the small droplet is different from the landing timing of the dot of the medium droplet, a deviation in landing position occurs between the dots $D_{D1}$ and $D_{F1}$ and the dots $D_{E1}$ and $D_{G1}$ and between the dots $D_{D3}$ and $D_{F3}$ and the dots $D_{E3}$ and $D_{G3}$ in the Y direction. Consequently, an omission that is a part in which the paper 1 is exposed in the solid portion occurs. As illustrated in FIG. 13, in a case where the landing timing of the dot of the small droplet and the landing timing of the dot of the medium droplet are appropriate, the dots $D_{D1}$, $D_{E1}$, $D_{F1}$, and $D_{G1}$, the dots $D_{D2}$, $D_{E2}$, $D_{F2}$, and $D_{G2}$, the dots $D_{D3}$, $D_{E3}$, $D_{F3}$, and $D_{G3}$, and the dots $D_{D4}$, $D_{E4}$, $D_{F4}$, and $D_{G4}$ are arranged with their centers at the same position in the Y direction, and the omission does not occur.

In a case where the landing timing of the dot of the small droplet and the landing timing of the dot of the medium droplet are appropriate, the omission does not occur in the solid portion even in a case where the dot of the small droplet coexists with the dot of the medium droplet. In a case where the landing timing of the dot of the small droplet is different from the landing timing of the dot of the medium droplet, the omission does not occur in a case where only the dot of the small droplet or the dot of the medium droplet is present. However, the omission may occur in a case where the dot of the small droplet coexists with the dot of the medium droplet.

Particularly, in a case where a dot movement caused by landing interference is not considered, the omission occurs more easily than that in the case of printing with only the dot of the small droplet without using the dot of the medium droplet, in a case where the landing position in the Y direction of the dot of the small droplet deviates from the landing position in the Y direction of the dot of the medium droplet by ½ or more of the difference between the dot diameter of the small droplet and the dot diameter of the medium droplet.

The deviation between the landing positions of dots of different modulated droplet amounts in the transport direction (Y direction) of the paper 1 causes the omission particularly in a high density portion and deteriorates image quality such as granularity. In addition, different ejection characteristics among the heads 36C, 36M, 36Y, and 36K cause in-plane unevenness.

In an image recording method according to the present embodiment, a deviation between the positions of the dot of the small droplet and the dot of the medium droplet in the Y direction is removed, and deterioration of the image quality is prevented.

<Drive Waveform of Ink Jet Head>

Figure 15:
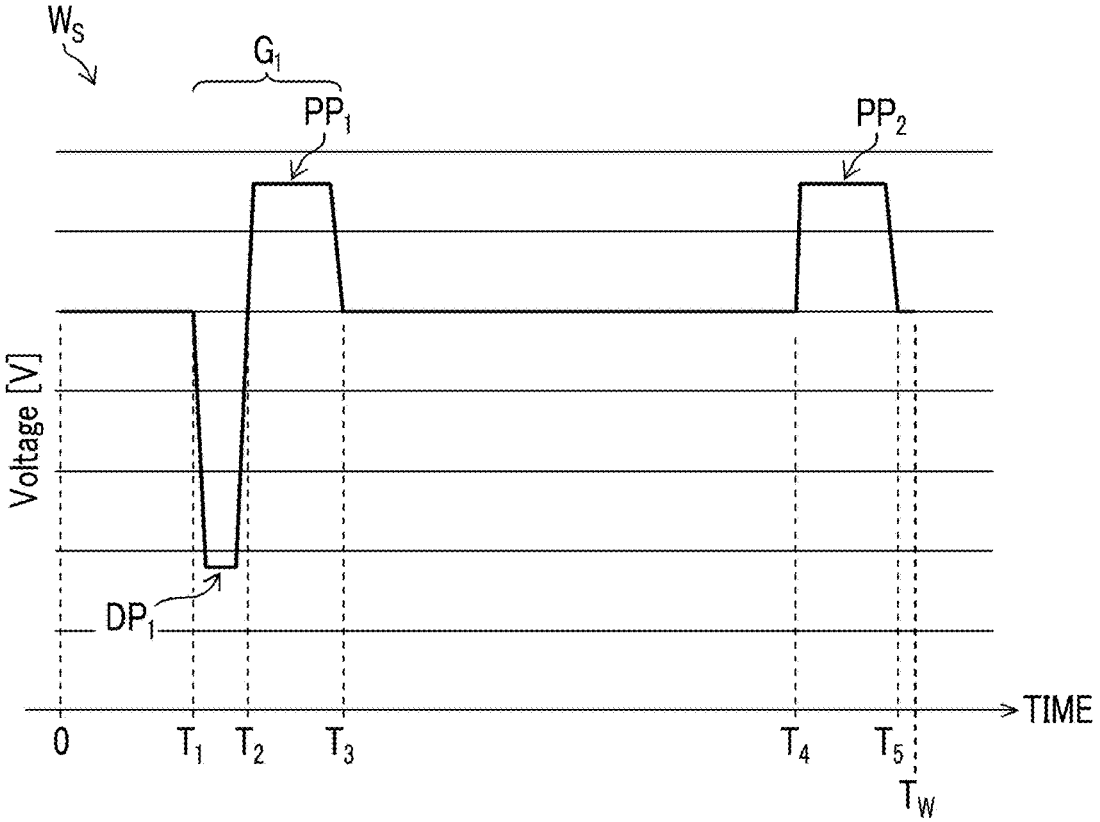
FIG. 15 is a timing chart illustrating a drive waveform of one drive cycle for forming the dot of the small droplet.
Figure 16:
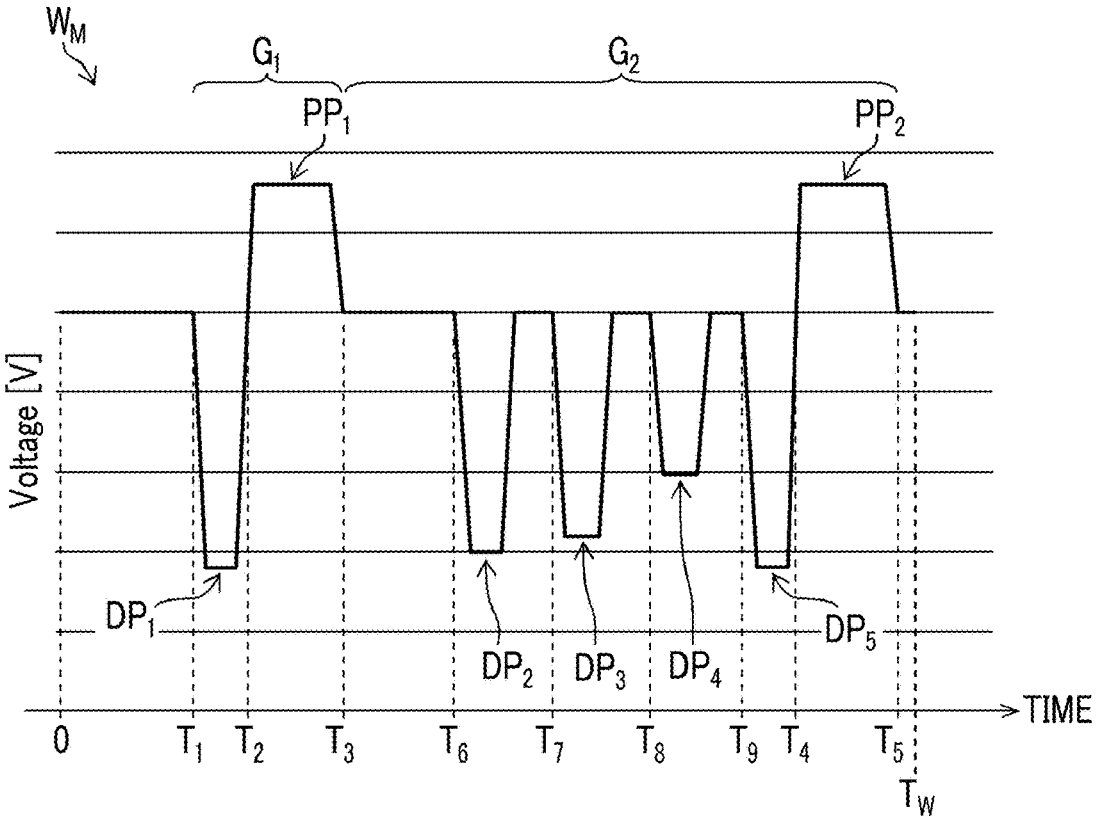
FIG. 16 is a timing chart illustrating a drive waveform of one drive cycle for forming the dot of the medium droplet.
Figure 17:
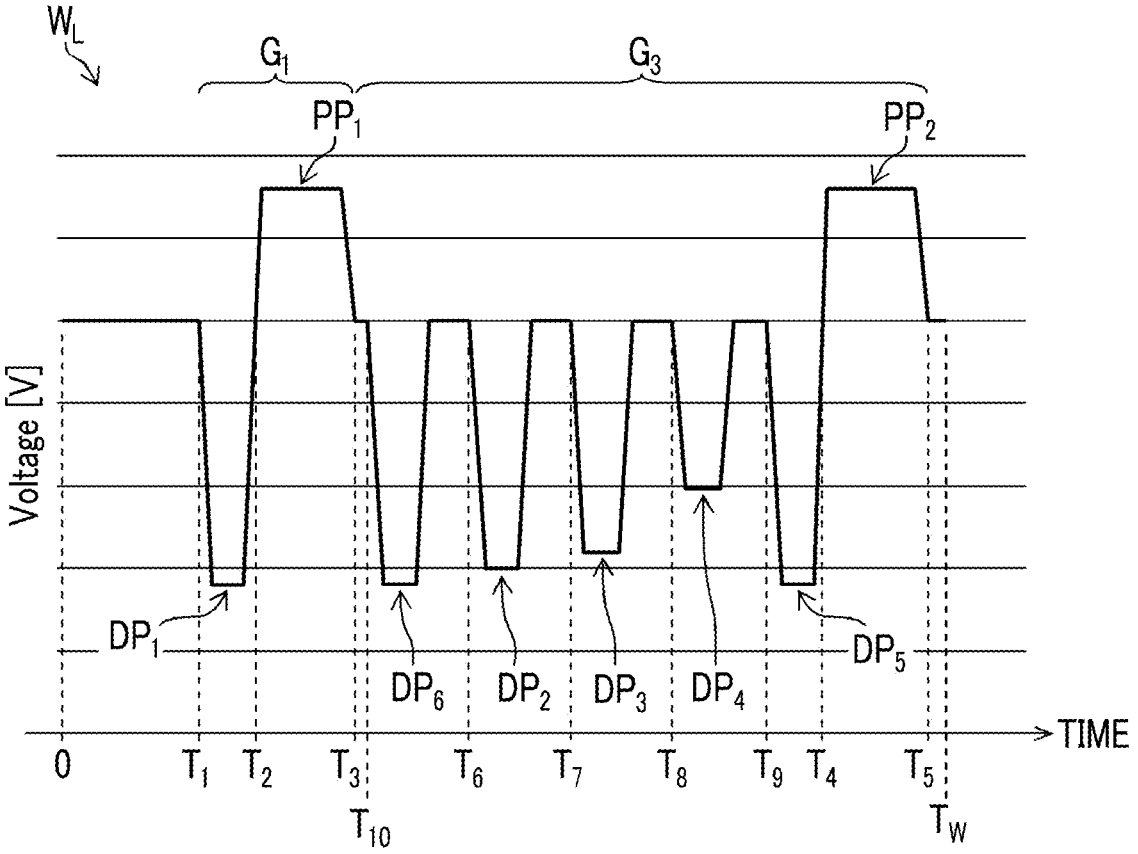
FIG. 17 is a timing chart illustrating a drive waveform of one drive cycle for forming a dot of a large droplet.

FIG. 15 to FIG. 17 are timing charts of the drive waveform of the ink jet head in the image recording method according to the present embodiment. A vertical axis denotes a voltage, and a horizontal axis denotes time. FIG. 15 to FIG. 17 respectively illustrate the drive waveforms of one drive cycle for forming the dot of the small droplet, the dot of the medium droplet, and the dot of the large droplet that is a relatively deeper and larger droplet than the medium droplet. One drive cycle starts in synchronization with the drive timing signal. Accordingly, a timing at which the drive timing signal is input corresponds to time 0 of each timing chart.

As illustrated in FIG. 15, the drive waveform $W_S$ for forming the dot of the small droplet is configured to include a drive pulse $DP_1$, a dereverberation pulse $PP_1$, and a dereverberation pulse $PP_2$ in time series order from the beginning in the drive cycle $T_W$ (one example of one drive cycle).

The drive pulse $DP_1$ is a pulse for pressurizing the pressure chamber 52 by the piezo actuator 58 and ejecting ink from the nozzle 51 and is a rectangular pulse having a relatively low voltage with respect to the bias voltage. The drive pulse $DP_1$ is output in the first half of the drive cycle $T_W$. In the example illustrated in FIG. 15, the drive pulse $DP_1$ is output between times $T_1$ and $T_2$. That is, $T_2<T_W/2$ is established.

The dereverberation pulse $PP_1$ and the dereverberation pulse $PP_2$ are pulses for causing reverberant meniscus vibration (one example of meniscus vibration) after ink droplet ejection (one example of liquid droplet ejection) to be statically determinate and are rectangular pulses having a relatively high voltage with respect to the bias voltage. The dereverberation pulse $PP_1$ is output between times $T_2$ and $T_3$, and the dereverberation pulse $PP_2$ is output between times $T_4$ and $T_5$.

In a case where the drive waveform $W_S$ generated in the above manner is applied to the individual electrode 57 of the piezo actuator 58, an ink droplet DRS (refer to FIG. 18) for forming the dot of the small droplet is ejected by the drive pulse $DP_1$ of a first ejection waveform element $G_1$, and the reverberant meniscus vibration is caused to be statically determinate by the dereverberation pulse $PP_1$ and the dereverberation pulse $PP_2$. A time at which the first ejection waveform element $G_1$ ends is $T_3$ (settling time).

In addition, the drive waveform $W_M$ for forming the dot of the medium droplet is configured to include the drive pulse $DP_1$, the dereverberation pulse $PP_1$, drive pulses $DP_2$, $DP_3$, $DP_4$, and $DP_5$, and the dereverberation pulse $PP_2$ in time series order from the beginning in the drive cycle $T_W$ as illustrated in FIG. 16.

The drive pulse $DP_1$, the dereverberation pulse $PP_1$, and the dereverberation pulse $PP_2$ are the same pulses as the drive pulse $DP_1$, the dereverberation pulse $PP_1$, and the dereverberation pulse $PP_2$ in the drive waveform $W_S$. That is, the drive waveform $W_M$ is configured by adding the drive pulses $DP_2$, $DP_3$, $DP_4$, and $DP_5$ to the drive waveform $W_S$.

Each of the drive pulses $DP_2$, $DP_3$, $DP_4$, and $DP_5$ is a pulse for ejecting ink from the nozzle 51 and is a rectangular pulse having a relatively low voltage with respect to the bias voltage. In addition, the output of the drive pulses $DP_2$, $DP_3$, $DP_4$, and $DP_5$ starts at times $T_6$, $T_7$, $T_8$, and $T_9$, respectively. The pulse interval of the drive pulses $DP_2$, $DP_3$, $DP_4$, and $DP_5$ is approximately equivalent to an acoustic resonance cycle Tc of a pressure wave in the pressure chamber 52. That is, in a case where ½ of the acoustic resonance cycle Tc of the pressure wave in the pressure chamber 52 is denoted by AL, $T_7-T_6\approx 2\times AL$, $T_8-T_7\approx 2\times AL$, $T_9-T_8\approx 2\times AL$, and $T_4-T_9\approx 2\times AL$ are established. By setting the pulse interval in such a manner, ink droplets can be efficiently ejected using a residual pressure.

In a case where the drive waveform $W_M$ generated in the above manner is applied to the individual electrode 57 of the piezo actuator 58, a preceding droplet $DRM_F$ (refer to FIG. 19) for forming the dot of the medium droplet is ejected by the drive pulse $DP_1$ of the first ejection waveform element $G_1$, and the reverberant meniscus vibration is caused to be statically determinate by the dereverberation pulse $PP_1$. Furthermore, a succeeding droplet $DRM_R$ (refer to FIG. 19) for forming the dot of the medium droplet is ejected by the drive pulses $DP_2$, $DP_3$, $DP_4$, and $DP_5$ of a second ejection waveform element $G_2$, and the reverberant meniscus vibration is caused to be statically determinate by the dereverberation pulse $PP_2$.

Furthermore, the drive waveform $W_L$ for forming the dot of the large droplet is configured to include the drive pulse $DP_1$, the dereverberation pulse $PP_1$, drive pulses $DP_6$, $DP_2$, $DP_3$, $DP_4$, and $DP_5$, and the dereverberation pulse $PP_2$ in time series order from the beginning in the drive cycle $T_W$ as illustrated in FIG. 17. The drive pulse $DP_1$, the dereverberation pulse $PP_1$, the drive pulses $DP_2$, $DP_3$, $DP_4$, and $DP_5$, and the dereverberation pulse $PP_2$ are the same pulses as the drive pulse $DP_1$, the dereverberation pulse $PP_1$, the drive pulses $DP_2$, $DP_3$, $DP_4$, and $DP_5$, and the dereverberation pulse $PP_2$ in the drive waveform $W_M$. That is, the drive waveform $W_L$ is configured by adding the drive pulse $DP_6$ to the drive waveform $W_M$.

The drive pulse $DP_6$ is a pulse for ejecting ink from the nozzle 51 and is a rectangular pulse having a relatively low voltage with respect to the bias voltage. The output of the drive pulse $DP_6$ starts at time $T_{10}$, and $T_{10}-T_6\approx Tc$ is established.

In a case where the drive waveform $W_L$ generated in the above manner is applied to the individual electrode 57 of the piezo actuator 58, a preceding droplet $DRL_F$ (refer to FIG. 20) for forming the dot of the large droplet is ejected by the drive pulse $DP_1$ of the first ejection waveform element $G_1$, and the reverberant meniscus vibration is caused to be statically determinate by the dereverberation pulse $PP_1$. Furthermore, a succeeding droplet $DRL_R$ (refer to FIG. 20) for forming the dot of the large droplet is ejected by the drive pulses $DP_6$, $DP_2$, $DP_3$, $DP_4$, and $DP_5$ of a third ejection waveform element $G_3$, and the reverberant meniscus vibration is caused to be statically determinate by the dereverberation pulse $PP_2$. Accordingly, the droplet amount of the dot of the large droplet is increased from the droplet amount of the dot of the medium droplet by the amount of ink droplet ejected by the drive pulse $DP_6$.

In a case where ½ of the acoustic resonance cycle Tc of the pressure wave in the pressure chamber 52 is denoted by AL, and the settling time that is a time until output is stabilized from switching the pulse selection switch 70 ON and OFF is denoted by $T_S$, it is preferable that a first period from time $T_3$ at which the output of the dereverberation pulse $PP_1$ ends until time $T_{10}$ at which the output of the drive pulse $DP_6$ starts (from a time at which the output of the first ejection waveform element $G_1$ ends until a time at which the output of the third ejection waveform element $G_3$ starts) satisfies Expression 1.

$$T_S \leq (T_{10} - T_3) \leq AL \quad \text{(Expression 1)}$$

That is, the first period is longer than or equal to the settling time of the pulse selection switch 70 and shorter than or equal to AL.

In a case where the first period is set to a period of AL to 2×AL, ejection may easily become unstable. Furthermore, in a case where the first period is set to be longer than or equal to 2×AL, the ejection timing of the succeeding droplet $DRL_R$ of the large droplet is delayed, and the amplitude of the drive pulse of the succeeding droplet $DRL_R$ needs to be increased in order to combine the succeeding droplet $DRL_R$ with the preceding droplet $DRL_F$.

The switch controller 84 sets the pulse selection switch 70 to be OFF in the first period and ON at time $T_4$ in a case where the drive waveform $W_S$ is selected and output. In a case where the pulse selection switch 70 is not included, the amplitude of the drive pulse $DP_6$ cannot be increased in order not to perform ejection based on the drive pulse $DP_6$ at the time of selecting the small droplet. In this case, the flight velocity of the succeeding droplet $DRL_R$ is decreased, and it is difficult to combine the succeeding droplet $DRL_R$ to form the large droplet. By selecting the pulse using the pulse selection switch 70, the amplitude of the drive pulse of the succeeding droplet $DRL_R$ can be increased, and the succeeding droplet $DRL_R$ of the large droplet is easily combined with the preceding droplet $DRL_F$ during its flight.

In addition, by setting the first period such that Expression 1 is satisfied, a voltage applied to the individual electrode 57 of the piezo actuator 58 until time $T_{10}$ can be stabilized in a case where the pulse selection switch 70 is set to be OFF at time $T_3$ at which the first ejection waveform element $G_1$ ends. In a case where the output of the pulse selection switch 70 can be stabilized until time $T_{10}$, the pulse selection switch 70 may be set to be OFF after time $T_3$.

In the present embodiment, the waveform generation unit 80 generates the digital drive waveform $W_L$, which is the reference drive waveform, in synchronization with the drive timing signal and generates the drive waveform $W_L$, the drive waveform $W_M$, and the drive waveform $W_S$ based on the digital drive waveform $W_L$.

In a case where the dot of the large droplet is formed, the switch controller 84 sets the pulse selection switch 70 to be ON at all times. Accordingly, the analog drive waveform $W_L$ is applied to the individual electrode 57 of the piezo actuator 58.

In addition, in a case where the dot of the medium droplet is formed, the switch controller 84 sets the pulse selection switch 70 to be ON in a period of time 0 to time $T_3$, OFF in the first period of time $T_3$ to time $T_{10}$, and ON at time $T_6$. By such control, the analog drive waveform $W_M$ in which the drive pulse $DP_6$ is not selected is applied to the individual electrode 57 of the piezo actuator 58.

Furthermore, in a case where the dot of the small droplet is formed, the switch controller 84 sets the pulse selection switch 70 to be ON in a period of time 0 to time $T_3$, OFF in the first period of time $T_3$ to time $T_{10}$, and ON at time $T_4$. By such control, the analog drive waveform $W_S$ in which the drive pulse $DP_6$, the drive pulse $DP_2$, the drive pulse $DP_3$, the drive pulse $DP_4$, and the drive pulse $DP_5$ are not selected is applied to the individual electrode 57 of the piezo actuator 58.

<Flight State of Ink Droplet>

Figure 18:
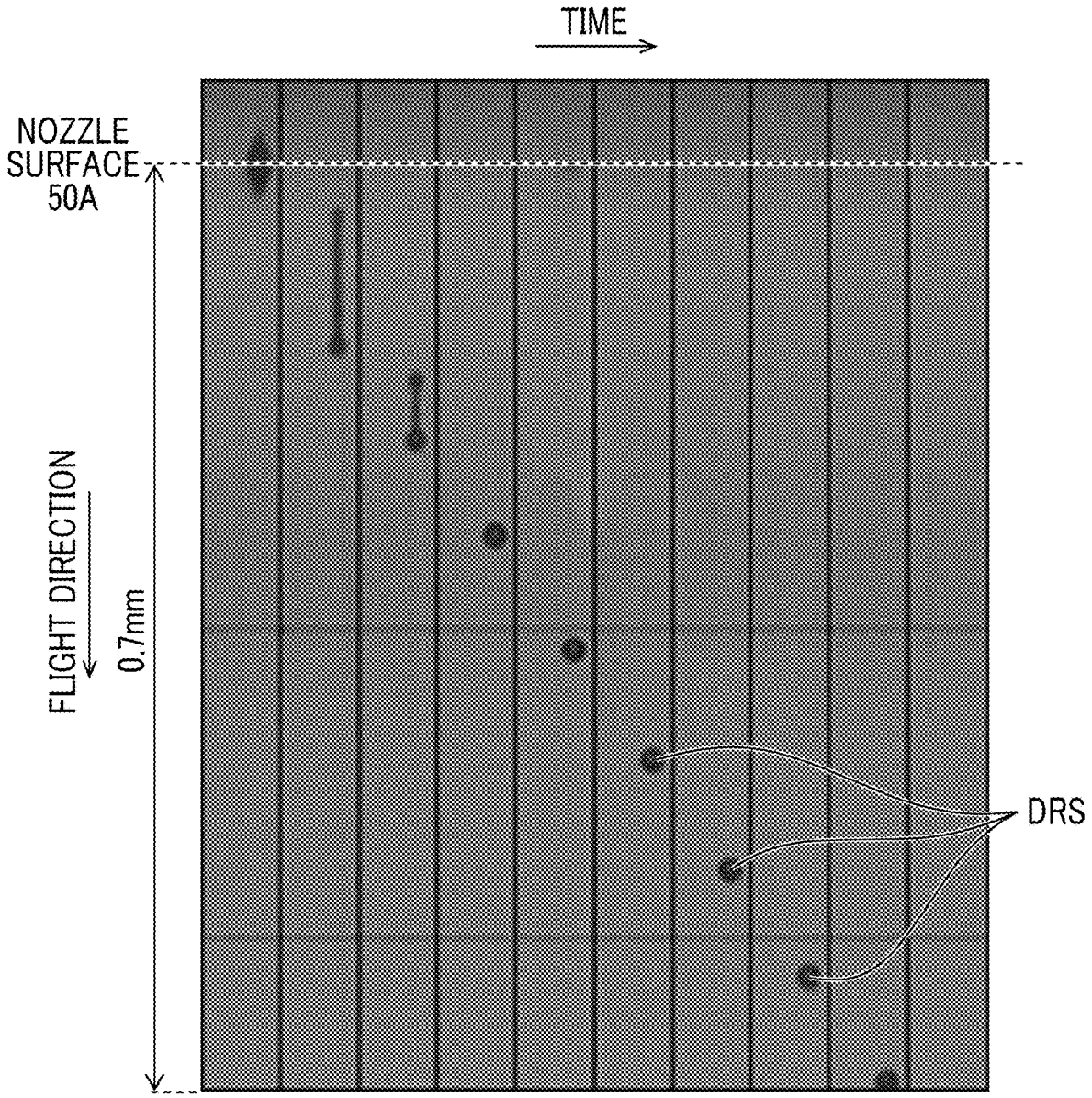
FIG. 18 is a continuous photo showing a state of flight of an ink droplet ejected from a nozzle.
Figure 19:
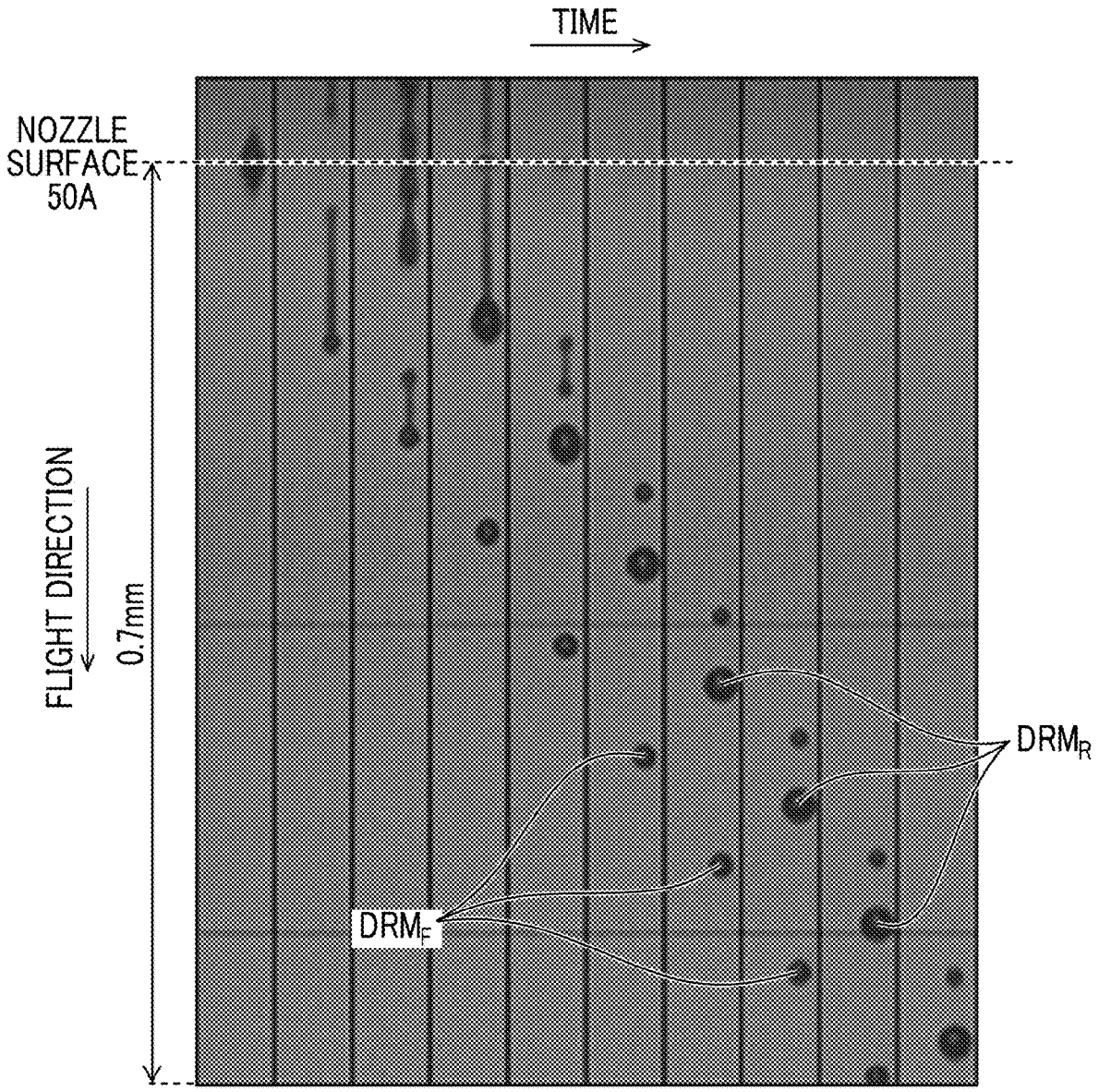
FIG. 19 is a continuous photo showing the state of flight of the ink droplet ejected from the nozzle.
Figure 20:
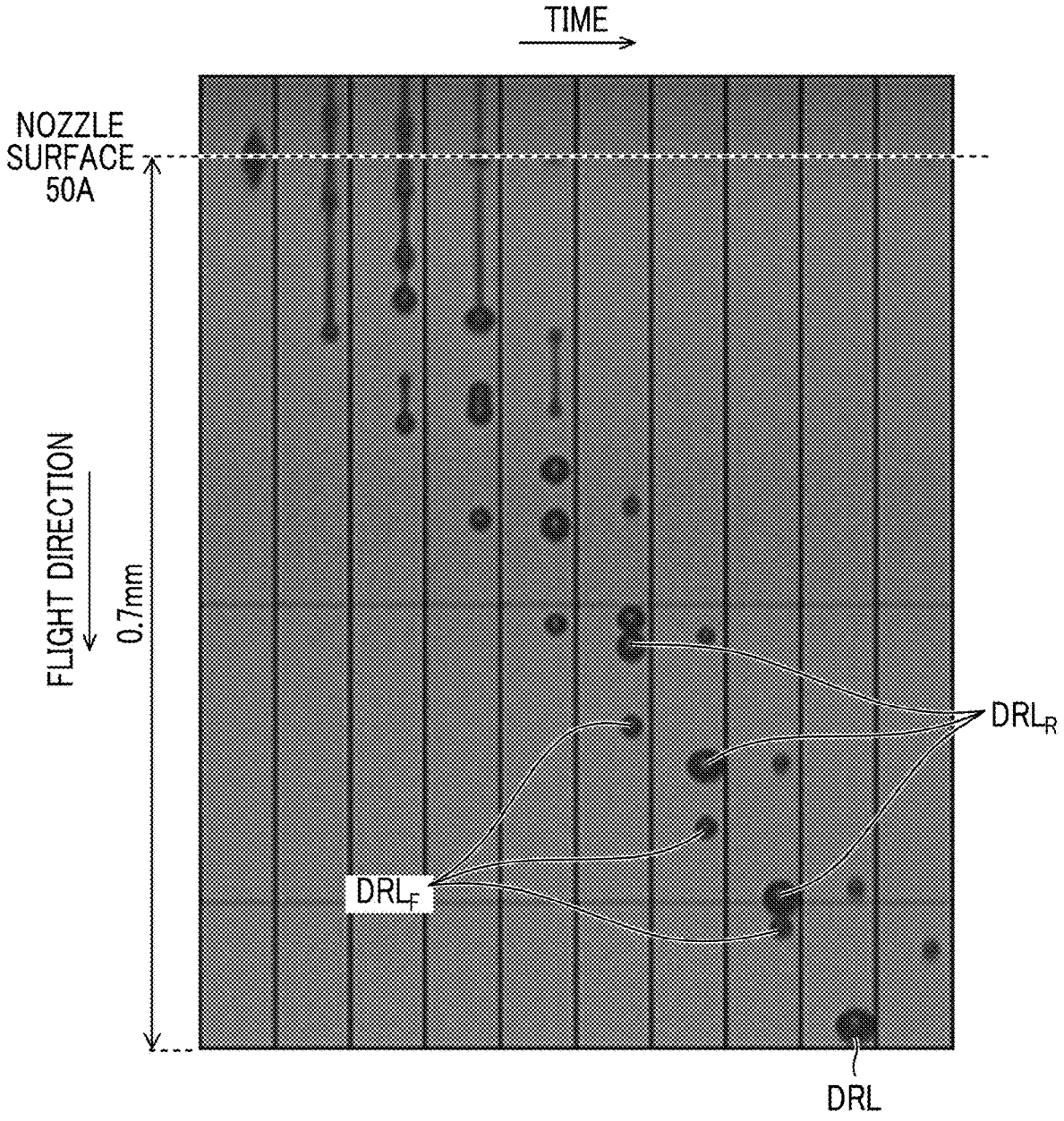
FIG. 20 is a continuous photo showing the state of flight of the ink droplet ejected from the nozzle.

FIG. 18 to FIG. 20 are continuous photos acquired by stroboscopically imaging the state of flight of the ink droplet ejected from the nozzle 51 for each constant time period in a case where each of the drive waveforms $W_S$ to $W_L$ is applied to the individual electrode 57 of the piezo actuator 58. In FIG. 18 to FIG. 20, a vertical direction in the drawing denotes a flight direction of the ink droplet, and a horizontal direction in the drawing denotes a change in time series from the left side toward the right side in the drawing. In addition, the position of a broken line in the drawing denotes the position of the nozzle surface 50A, and the distance from the position of the broken line in the drawing to the lower end of the drawing is 0.7 mm which is the same as the distance from the nozzle surface 50A to the recording surface of the paper 1 in the ink jet recording device 10. Accordingly, the lower end of the drawing is regarded as the position of the recording surface of the paper 1.

As illustrated in FIG. 18, in a case where the drive waveform $W_S$ is applied, the ink droplet DRS is ejected by the drive pulse $DP_1$ of the first ejection waveform element $G_1$.

In addition, as illustrated in FIG. 19, in a case where the drive waveform $W_M$ is applied, the preceding droplet $DRM_F$ is first ejected by the drive pulse $DP_1$ of the first ejection waveform element $G_1$. After the preceding droplet $DRM_F$ is separated from the nozzle 51 (not illustrated in FIG. 19), the succeeding droplet $DRM_R$ is then ejected as a whole by the drive pulses $DP_2$, $DP_3$, $DP_4$, and $DP_5$ of the second ejection waveform element $G_2$. The preceding droplet $DRM_F$ and the succeeding droplet $DRM_R$ are not combined during their flight. That is, the preceding droplet $DRM_F$ and the succeeding droplet $DRM_R$ are not combined while reaching the paper 1 after being ejected from the nozzle 51 and are combined on the recording surface of the paper 1.

Combining on the recording surface of the paper 1 means that the distance between the centers of the dot formed by the preceding droplet $DRM_F$ and the dot formed by the succeeding droplet $DRM_R$ is shorter than or equal to the radius of the dot of the succeeding droplet $DRM_R$.

Furthermore, as illustrated in FIG. 20, in a case where the drive waveform $W_L$ is applied, the preceding droplet $DRL_F$ is ejected by the drive pulse $DP_1$ of the first ejection waveform element $G_1$. After the preceding droplet $DRL_F$ is separated from the nozzle 51 (not illustrated in FIG. 20), the succeeding droplet $DRL_R$ is ejected as a whole by the drive pulses $DP_6$, $DP_2$, $DP_3$, $DP_4$, and $DP_5$ of the third ejection waveform element $G_3$. The preceding droplet $DRL_F$ and the succeeding droplet $DRL_R$ are combined during their flight and become an ink droplet DRL, and land almost at the same time as their combining.

The ink droplet DRS of the dot of the small droplet and the preceding droplet $DRM_F$ of the dot of the medium droplet are ejected by the first ejection waveform element $G_1$ having the same shape of the waveform, the voltage, and the output timing. In addition, the preceding droplet $DRM_F$ of the dot of the medium droplet lands on the recording surface of the paper 1 without being combined with the succeeding droplet $DRM_R$ during its flight. Accordingly, a time period from the start of ejection until landing is the same, and a deviation in landing position in the Y direction does not occur between the ink droplet DRS of the dot of the small droplet and the preceding droplet $DRM_F$ of the dot of the medium droplet. Furthermore, the preceding droplet $DRM_F$ of the dot of the medium droplet is combined with the succeeding droplet $DRM_R$ after landing. Accordingly, a deviation in landing position in the Y direction does not occur between the dot of the small droplet and the dot of the medium droplet.

<Landing State of Dot>

Figure 21:
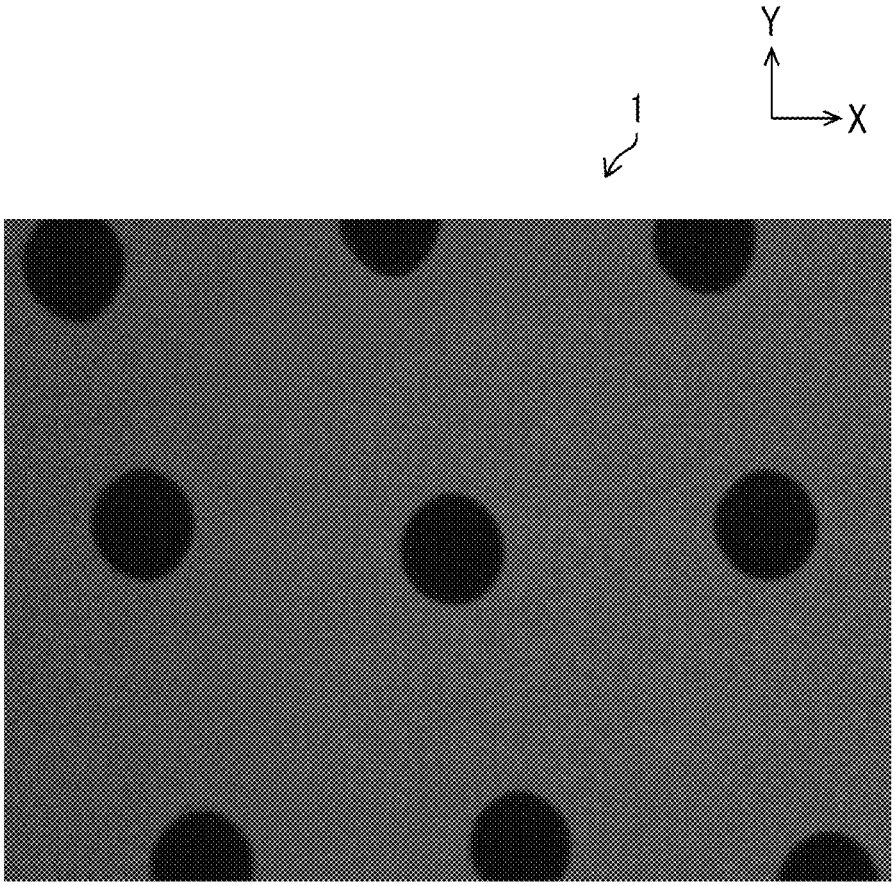
FIG. 21 is a photo showing a landing state of the dot of the medium droplet.
Figure 22:
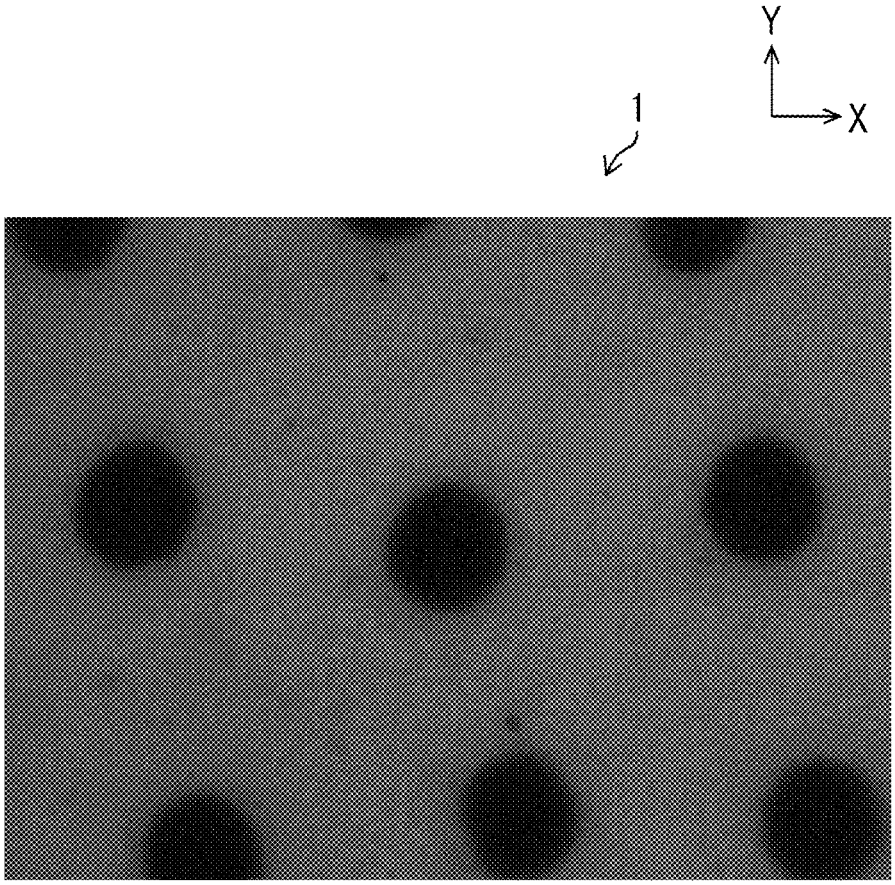
FIG. 22 is a photo showing the landing state of the dot of the medium droplet.
Figure 23:
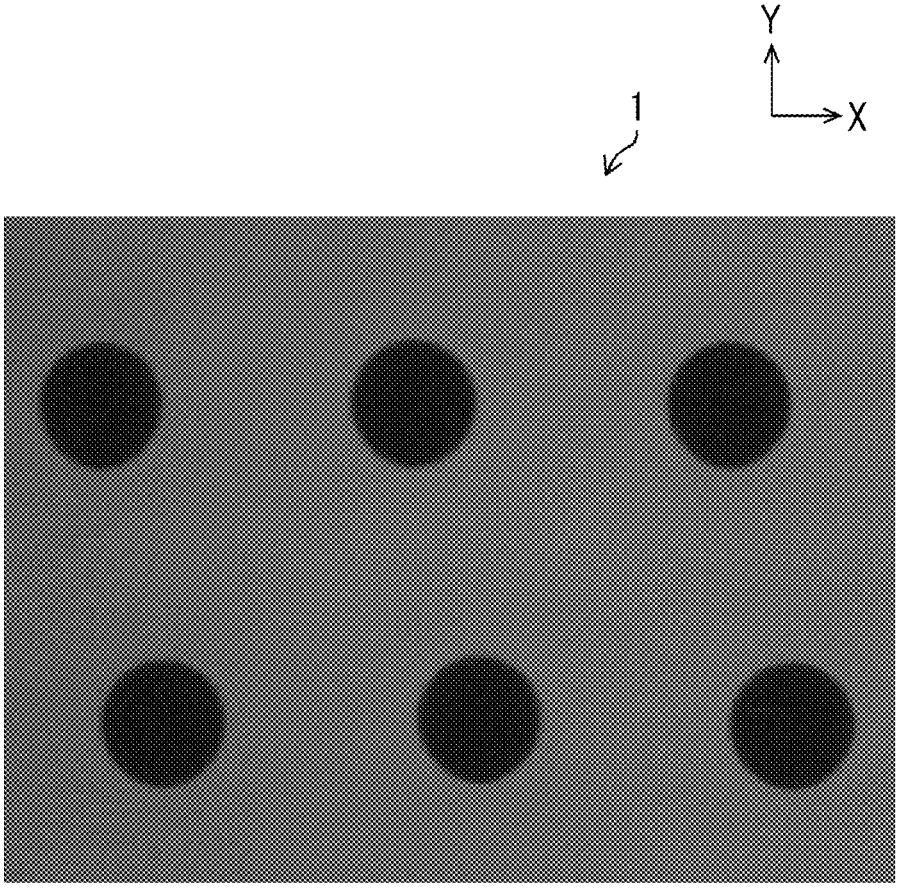
FIG. 23 is a photo showing a landing state of the dot of the large droplet.
Figure 24:
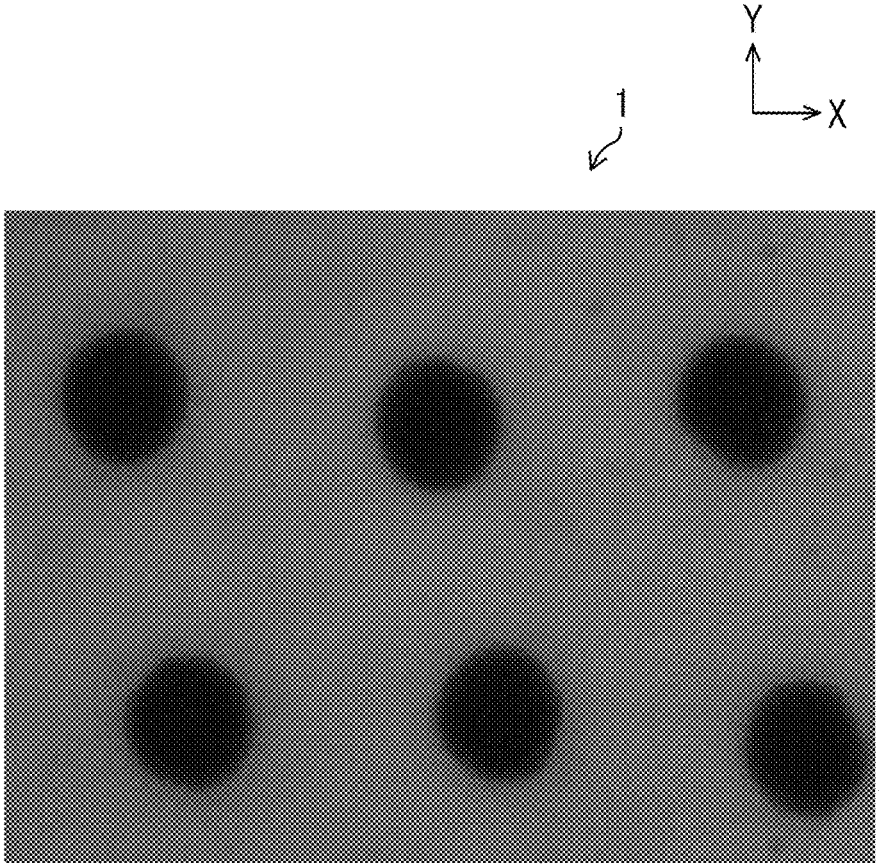
FIG. 24 is a photo showing the landing state of the dot of the large droplet.

FIG. 21 and FIG. 22 are photos illustrating a landing state of the dot of the medium droplet on the recording surface of the paper 1. FIG. 23 and FIG. 24 are photos illustrating a landing state of the dot of the large droplet. FIG. 21 and FIG. 23 illustrate a case where ink jet paper having high absorbency is used as the paper 1 without applying pre-coating liquid. FIG. 22 and FIG. 24 illustrate a case where coated paper used in printing is used by applying the pre-coating liquid. The pre-coating liquid is liquid having a function of coagulating a pigment component included in the ink droplet provided to the recording surface after applying the pre-coating liquid in advance on the recording surface of the paper 1.

The ink jet paper quickly absorbs ink. Thus, as illustrated in FIG. 21, the dot of the medium droplet is formed in an elliptic shape that is long in the Y direction by the deviation between the landing position of the preceding droplet and the landing position of the succeeding droplet In addition, as illustrated in FIG. 23, the dot of the large droplet is formed in an almost circular shape regardless of the speed of ink absorption because the preceding droplet and the succeeding droplet are combined during their flight.

The coated paper slowly absorbs ink, and landing interference causes the succeeding droplet to move in a direction approaching the dot of the preceding droplet and combine with the preceding droplet. Thus, as illustrated in FIG. 22, the dot of the medium droplet is formed in a more circular shape than that in the case of the ink jet paper. In addition, as illustrated in FIG. 24, the dot of the large droplet is formed in an almost circular shape because the preceding droplet and the succeeding droplet are combined during their flight. The dots in FIG. 22 and FIG. 24 are blurred due to unevenness of the coated paper.

The succeeding droplet $DRM_R$ of the medium droplet is ejected using a consecutive ejection drive method. Thus, the relative flight velocities of the ink droplet DRS of the dot of the small droplet and the preceding droplet $DRM_F$ of the medium droplet may vary depending on the head 36. In a case where variation occurs in the relative flight velocities of the preceding droplet $DRM_F$ and the succeeding droplet $DRM_R$ of the medium droplet among the heads 36, variation occurs in the difference between landing positions of the preceding droplet $DRM_F$ and the succeeding droplet $DRM_R$ of the medium droplet among the heads 36, and variation occurs in the way of spreading of the dot of the medium droplet among the heads 36.

Figure 25:
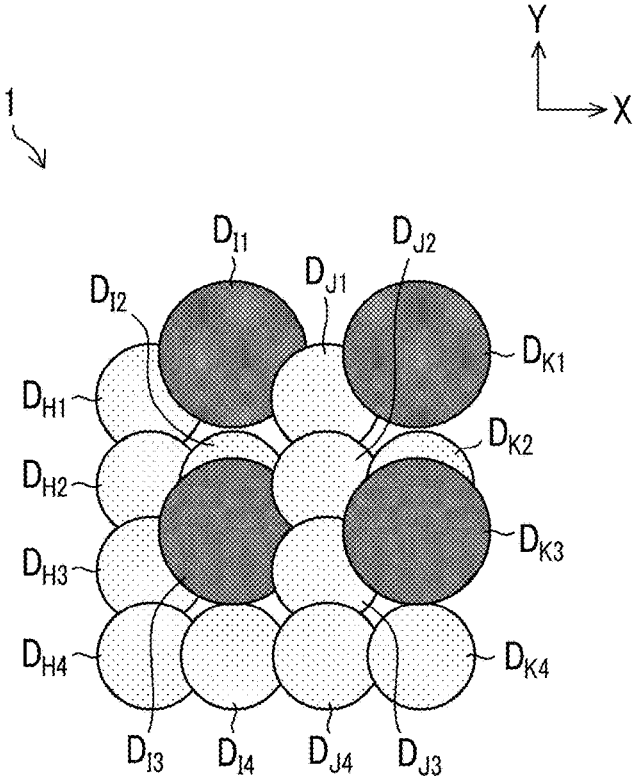
FIG. 25 is a diagram illustrating a solid portion formed using the dot of the small droplet and the dot of the medium droplet.
Figure 26:
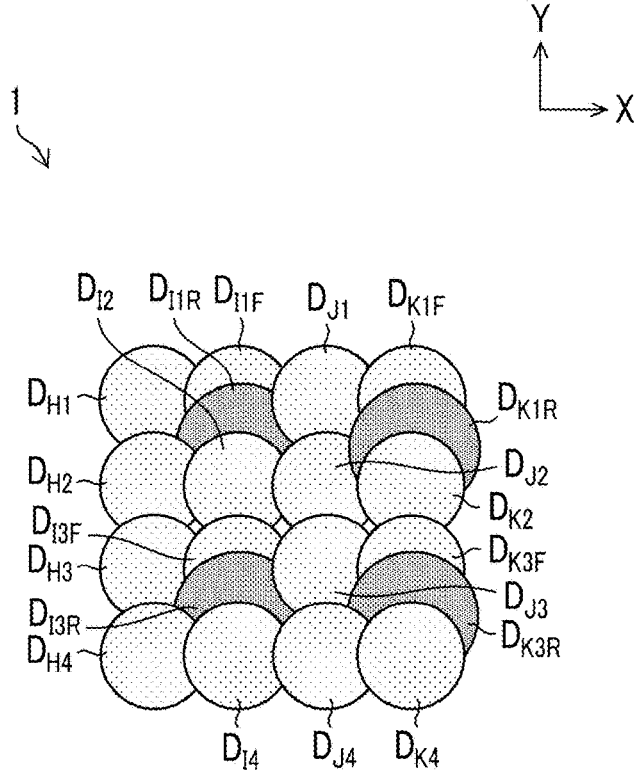
FIG. 26 is a diagram illustrating a solid portion formed using the dot of the small droplet and the dot of the medium droplet.

Each of FIG. 25 and FIG. 26 is a diagram schematically illustrating a solid portion formed on the paper 1 using the dot of the small droplet and the dot of the medium droplet. FIG. 25 illustrates a case of the related art where the landing position of the dot of the small droplet deviates from the landing position of the dot of the medium droplet. FIG. 26 illustrates a case of the present embodiment where the landing position of the dot of the small droplet is the same as the landing position of the preceding droplet $DRM_F$ of the medium droplet and the landing position of the succeeding droplet $DRM_R$ of the medium droplet deviates in the Y direction.

In FIG. 25 and FIG. 26, dots $D_{H1}$ to $D_{H4}$ are dots of the small droplets formed by a nozzle H. Dots $D_{I1}$ and $D_{I3}$ are dots of the medium droplets formed by a nozzle I. Dots $D_{I2}$ and $D_{I4}$ are dots of the small droplets formed by the nozzle I. Dots $D_{J1}$ to $D_{J4}$ are dots of the small droplets formed by a nozzle J. Dots $D_{K1}$ and $D_{K3}$ are dots of the medium droplets formed by a nozzle K. Dots $D_{K2}$ and $D_{K4}$ are dots of the small droplets formed by the nozzle K. In FIG. 26, the dots $D_{I1}$, $D_{I3}$, $D_{K1}$, and $D_{K3}$ are illustrated as being separated into a dot $D_{I1F}$ based on the preceding droplet $DRM_F$ and a dot $D_{I1R}$ based on the succeeding droplet $DRM_R$, a dot $D_{I3F}$ based on the preceding droplet $DRM_F$ and a dot $D_{I3R}$ based on the succeeding droplet $DRM_R$, a dot $D_{K1F}$ based on the preceding droplet $DRM_F$ and a dot $D_{K1R}$ based on the succeeding droplet $DRM_R$, and a dot $D_{K3F}$ based on the preceding droplet $DRM_F$ and a dot $D_{K3R}$ based on the succeeding droplet $DRM_R$, respectively.

In addition, the dots $D_{H1}$, $D_{I1}$, $D_{J1}$, and $D_{K1}$ are dots of which the centers are to be arranged at the same position in the Y direction. Similarly, the dots $D_{H2}$, $D_{I2}$, $D_{J2}$, and $D_{K2}$, the dots $D_{H3}$, $D_{I3}$, $D_{J3}$, and $D_{K3}$, and the dots $D_{H4}$, $D_{I4}$, $D_{J4}$, and $D_{K4}$ are dots of which the centers are to be arranged at the same position in the Y direction.

As illustrated in FIG. 25, in the case of the related art, the omission occurs between the dot $D_{I1}$ and the dot $D_{I2}$.

As illustrated in FIG. 26, in the case of the present embodiment, the dot $D_{I1F}$ is at the same landing position in the Y direction as the dots $D_{H1}$, $D_{J1}$, and $D_{K1}$, and the dot $D_{I1R}$ lands at a position between the dot $D_{I1F}$ and the dot $D_{I2}$ in the Y direction. Thus, even in a case where the landing position of the dot $D_{I1R}$ slightly deviates, the omission does not easily occur. The same applies to the relationship between the dot $D_{K1F}$ and the dot $D_{K1R}$, between the dot $D_{I3F}$ and the dot $D_{I3R}$, and between the dot $D_{K3F}$ and the dot $D_{K3R}$. Accordingly, the effect of improving the image quality is expected.

A drive method in JP2016-510703A uses a multi-pulse waveform in which ejection of the small droplet uses one pulse, and the subsequent output drive pulse uses the residual pressure of the drive pulse in ejection of the medium droplet and ejection of the large droplet. Thus, the drop velocities of the small droplet, the medium droplet, and the large droplet differ for each head due to individual differences in natural frequency for each head. Thus, the landing timing of each of the small droplet, the medium droplet, and the large droplet in the drive cycle differs for each head. Accordingly, a deviation occurs in the landing positions of the small droplet, the medium droplet, and the large droplet in the transport direction of the recording medium for each head, and an image having different granularity for each head is formed and visually recognized as in-plane unevenness.

The landing position of each droplet can be matched by adjusting the drive pulses of the small droplet, the medium droplet, and the large droplet for each head. However, since the relationship between the droplet amount and the flight velocity differs for each head, matching the landing positions causes a deviation between the droplet amount and a design value for each head, and unevenness in density occurs. It is difficult to match the droplet amounts between the heads and match the landing positions between droplet types at the same time.

According to the present embodiment, the landing positions of the dot of the small droplet and the dot of the medium droplet can be matched regardless of the performance of the liquid ejection head. Thus, a common drive waveform can be used between the heads, and the droplet amount can be matched between the heads.

<Conditions for Not Combining and Combining Preceding Droplet and Succeeding Droplet>

In a case where the distance from the nozzle surface 50A to the recording surface of the paper 1 is denoted by D, the average velocity (droplet velocity) from ejection to landing of the preceding droplet $DRM_F$ of the medium droplet is denoted by $V_{MP}$, the droplet velocity of the succeeding droplet $DRM_R$ of the medium droplet is denoted by $V_{MS}$, a time period from the start of the drive waveform $W_M$ until ejection of the preceding droplet $DRM_F$ is denoted by $P_{MP}$, and a time period from the start of the drive waveform $W_M$ until ejection of the succeeding droplet $DRM_R$ is denoted by $P_{MS}$, a condition for not combining the preceding droplet $DRM_F$ and the succeeding droplet $DRM_R$ of the medium droplet during their flight can be represented as in Expression 2.

$$D/V_{MP}+(P_{MS}-P_{MP})<D/V_{MS} \quad \text{(Expression 2)}$$

In addition, in a case where the droplet velocity of the preceding droplet $DRL_F$ of the large droplet is denoted by $V_{LP}$, the droplet velocity of the succeeding droplet $DRL_R$ of the large droplet is denoted by $V_{LS}$, a time period from the start of the drive waveform $W_L$ until ejection of the preceding droplet $DRL_F$ is denoted by $P_{LP}$, and a time period from the start of the drive waveform $W_L$ until ejection of the succeeding droplet $DRL_R$ is denoted by $P_{LS}$, a condition for combining the preceding droplet $DRL_F$ and the succeeding droplet $DRL_R$ of the large droplet during their flight can be represented as in Expression 3.

$$D/V_{LP}+(P_{LS}-P_{LP})\geq D/V_{LS} \quad \text{(Expression 3)}$$

<Another Aspect of Drive Waveform>

FIG. 27 to FIG. 31 are timing charts of drive waveforms according to another aspect. A vertical axis denotes a voltage, and a horizontal axis denotes time.

Figure 27:
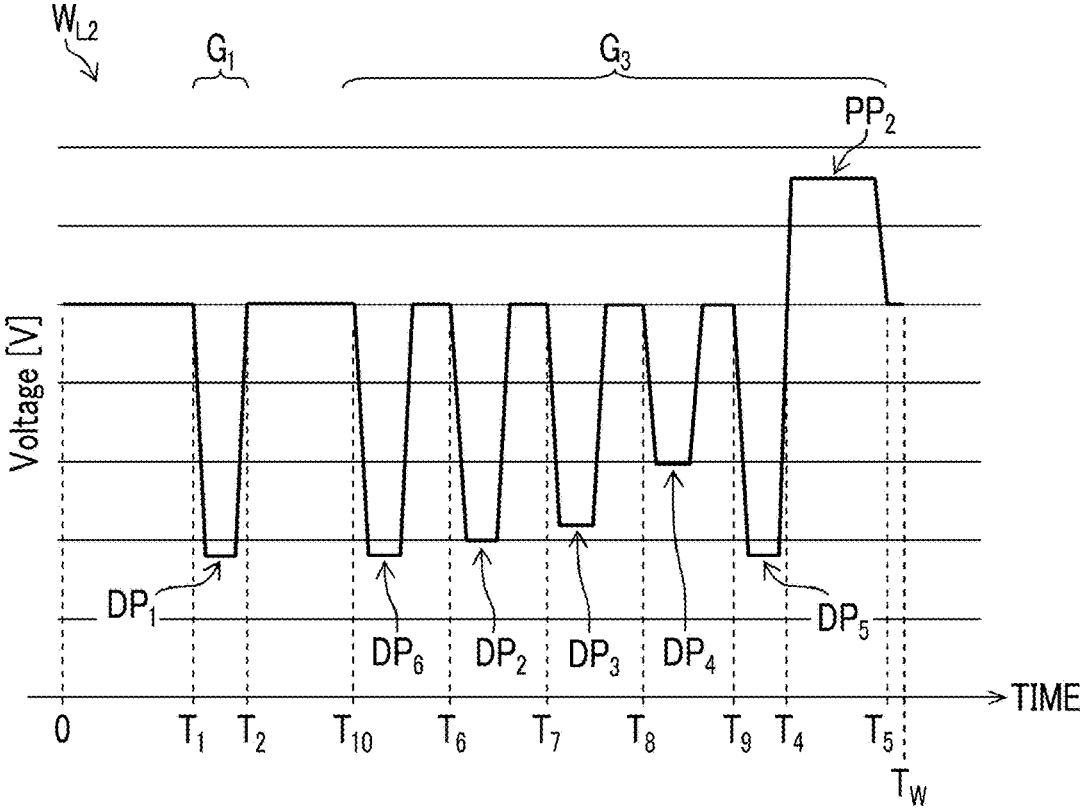
FIG. 27 is a timing chart illustrating the drive waveform of one drive cycle for forming the dot of the large droplet.

FIG. 27 is a timing chart illustrating a drive waveform $W_{L2}$ of one drive cycle for forming the dot of the large droplet. As illustrated in FIG. 27, the drive waveform $W_{L2}$ is configured to include the drive pulse $DP_1$, the drive pulses $DP_6$, $DP_2$, $DP_3$, $DP_4$, and $DP_5$, and the dereverberation pulse $PP_2$ in time series order from the beginning in the drive cycle $T_W$. The drive waveform $W_{L2}$ is different from the drive waveform $W_L$ illustrated in FIG. 17 in that the drive waveform $W_{L2}$ does not include the dereverberation pulse $PP_1$.

In a case where the drive waveform $W_{L2}$ generated in the above manner is applied to the individual electrode 57 of the piezo actuator 58, the preceding droplet $DRL_F$ for forming the dot of the large droplet is ejected by the drive pulse $DP_1$ of the first ejection waveform element $G_1$, and the succeeding droplet $DRL_R$ for forming the dot of the large droplet is ejected by the drive pulses $DP_6$, $DP_2$, $DP_3$, $DP_4$, and $DP_5$ of the third ejection waveform element $G_3$. The reverberant meniscus vibration is caused to be statically determinate by the dereverberation pulse $PP_2$.

Based on the drive waveform $W_{L2}$, a drive waveform for forming the dot of the medium droplet can be acquired by not selecting the drive pulse $DP_6$, and a drive waveform for forming the dot of the small droplet can be acquired by not selecting the drive pulses $DP_6$, $DP_2$, $DP_3$, $DP_4$, and $DP_5$.

Even in a case where the dereverberation pulse $PP_1$ is not included in the first ejection waveform element $G_1$, a deviation in landing position in the Y direction does not occur between the dot of the small droplet and the dot of the medium droplet, and the same effect as in the case of including the dereverberation pulse $PP_1$ can be achieved.

In addition, the drive waveform for forming the dot of the medium droplet may be a waveform in which two drive pulses having the same waveform are arranged and the effect of the reverberant vibration after ejection is not present. Since ejection of the preceding droplet and the succeeding droplet has the same waveform, and the effect of the reverberant vibration is not present, the drop velocity is the same as that at the time of ejecting the small droplet regardless of the characteristics of the head. That is, the landing timing of the succeeding droplet is the same regardless of the characteristics of the head, and the effect of reducing in-plane variation is achieved. In this case, it is desirable that a drive waveform for forming the dot of the large droplet is acquired by adding the drive pulse after the drive pulse of the preceding droplet and not adding the drive pulse ahead of the drive pulse of the preceding droplet in time series such that the preceding droplet and the succeeding droplet are combined.

In addition, particularly, in the case of printing at high density, non-printing pixels are almost not present, and pixels of the dot of the small droplet and the dot of the medium droplet are increased. In a case where two drive pulses having the same waveform are arranged in the drive waveform for forming the dot of the medium droplet, it is desirable that the ejection timings of the two drive pulses are timings deviating from each other by ½ of the drive cycle in order to improve the image quality at high density.

By using such a drive waveform, the succeeding droplet can land at the center between pixels in the transport direction of the paper 1. Thus, high resolution can be achieved in the transport direction, and the image quality of the image can be increased.

Figure 28:
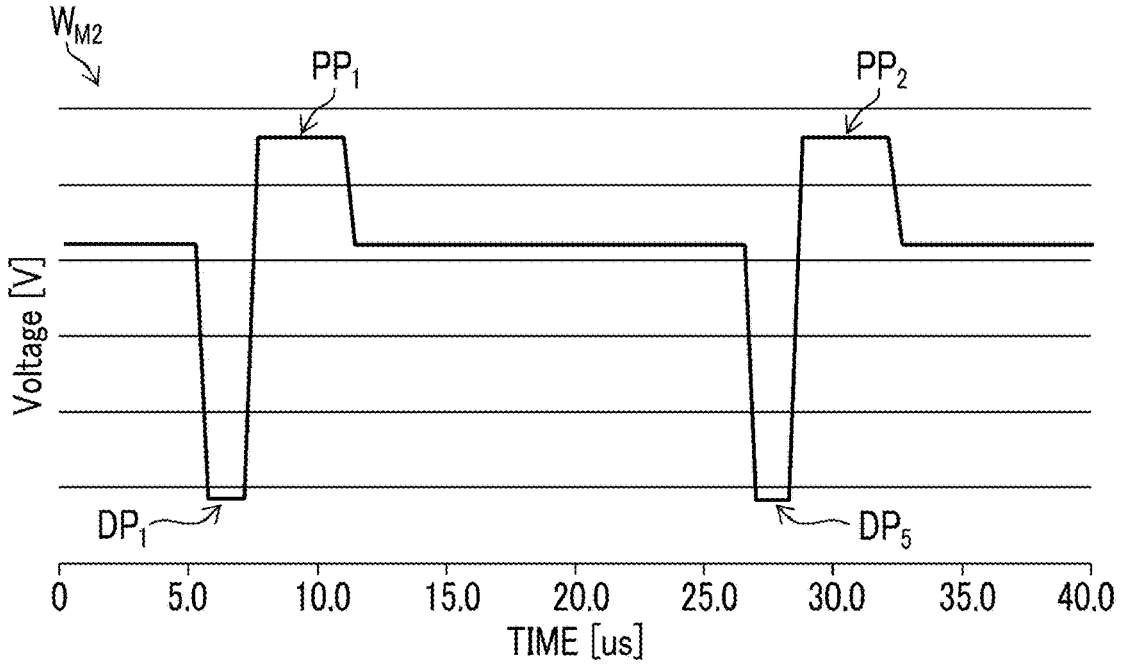
FIG. 28 is a timing chart illustrating the drive waveform of one drive cycle for forming the dot of the medium droplet.

FIG. 28 is a timing chart illustrating a drive waveform $W_{M2}$ of one drive cycle for forming the dot of the medium droplet in a case where a printing frequency is 25 kHz (drive cycle is 40 μs).

The drive waveform $W_{M2}$ is configured to include the drive pulse $DP_1$, the dereverberation pulse $PP_1$, the drive pulse $DP_5$, and the dereverberation pulse $PP_2$ in time series order from the beginning in the drive cycle. The drive pulse $DP_1$ and the drive pulse $DP_5$ have the same waveform, and the dereverberation pulse $PP_1$ and the dereverberation pulse $PP_2$ have the same waveform. In addition, it is desirable that the drive pulse $DP_1$ and the drive pulse $DP_5$ are arranged at timings deviating from each other by 20 μs which is ½ of the drive cycle. However, considering the timing of the drive pulse for forming the large droplet (refer to FIG. 31), approximately 21 μs is set in the example illustrated in FIG. 28. A deviation of approximately ±10% of ½ of the drive cycle can be allowed for the interval between the arrangements of two drive pulses. That is, the interval between the drive pulse $DP_1$ and the drive pulse $DP_5$ may be 18 μs to 22 μs. Even in a case where the deviation is allowed, the image quality is not affected.

Figure 29:
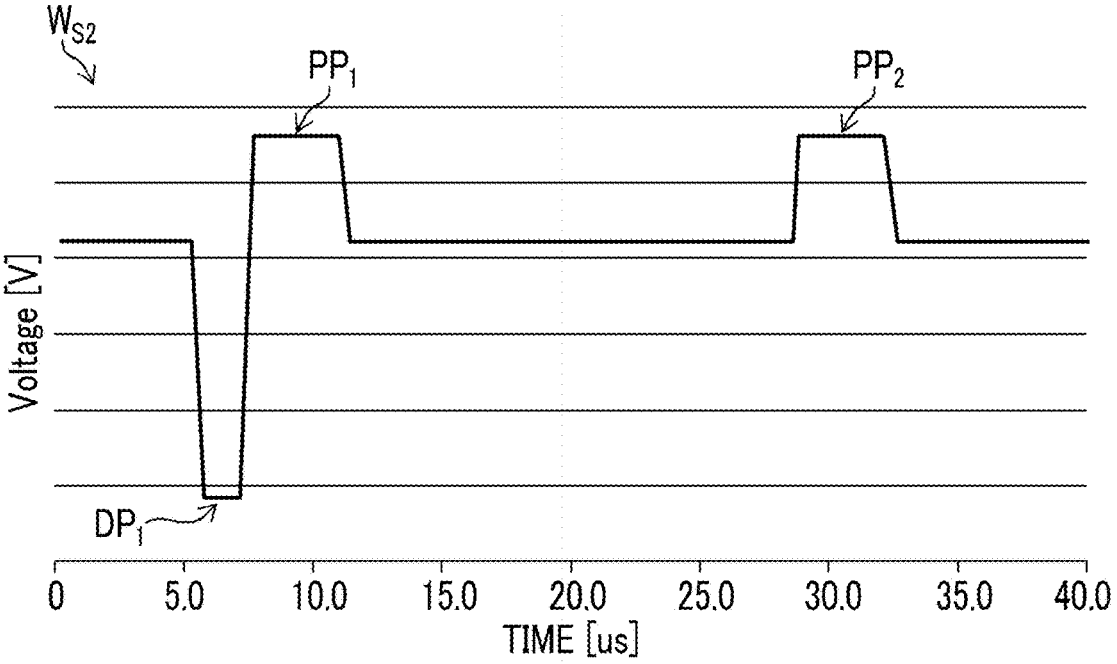
FIG. 29 is a timing chart illustrating the drive waveform of one drive cycle for forming the dot of the small droplet.
Figure 30:
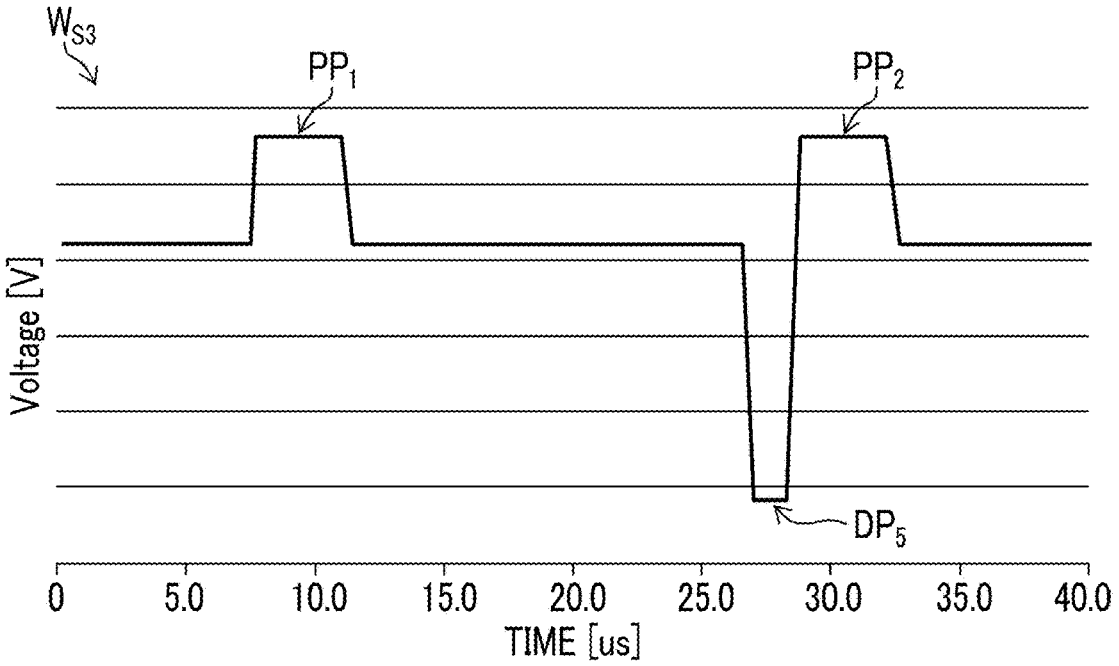
FIG. 30 is a timing chart illustrating the drive waveform of one drive cycle for forming the dot of the small droplet.

FIG. 29 and FIG. 30 are timing charts illustrating drive waveforms $W_{S2}$ and $W_{S3}$ of one drive cycle for forming the dot of the small droplet in a case where the printing frequency is 25 kHz (drive cycle is 40 μs).

The drive waveform $W_{S2}$ is configured to include the drive pulse $DP_1$, the dereverberation pulse $PP_1$, and the dereverberation pulse $PP_2$ in time series order from the beginning in the drive cycle. In addition, the drive waveform $W_{S3}$ is configured to include the dereverberation pulse $PP_1$, the drive pulse $DP_5$, and the dereverberation pulse $PP_2$ in time series order from the beginning in the drive cycle. The preceding droplet ejected by the drive pulse $DP_1$ and the succeeding droplet ejected by the drive pulse $DP_5$ are not combined during their flight and are combined on the recording surface of the paper 1 after landing.

The dot of the small droplet can be formed by any drive waveform of the drive waveforms $W_{S2}$ and $W_{S3}$.

That is, in a case where the dot of the small droplet is formed by the drive waveform $W_{S2}$, the dot of the small droplet and the dot of the preceding droplet ejected by the drive pulse $DP_1$ of the drive waveform $W_{M2}$ of the medium droplet land at the same timing in the drive cycle. In addition, the dot of the succeeding droplet ejected by the drive pulse $DP_5$ of the drive waveform $W_{M2}$ of the medium droplet lands at a timing late by approximately ½ of the drive cycle.

In addition, in a case where the dot of the small droplet is formed by the drive waveform $W_{S3}$, the dot of the small droplet and the dot of the succeeding droplet ejected by the drive pulse $DP_5$ of the drive waveform $W_{M2}$ of the medium droplet land at the same timing in the drive cycle. In addition, the dot of the preceding droplet ejected by the drive pulse $DP_1$ of the drive waveform $W_{M2}$ of the medium droplet lands at a timing early by approximately ½ of the drive cycle.

Even in a case where the dot of the small droplet is formed by any drive waveform of the drive waveforms $W_{S2}$ and $W_{S3}$, a deviation in landing position in the Y direction does not occur between the dot of the small droplet and the dot of the medium droplet. High resolution can be achieved in the transport direction, and the image quality of the image can be increased.

Figure 31:
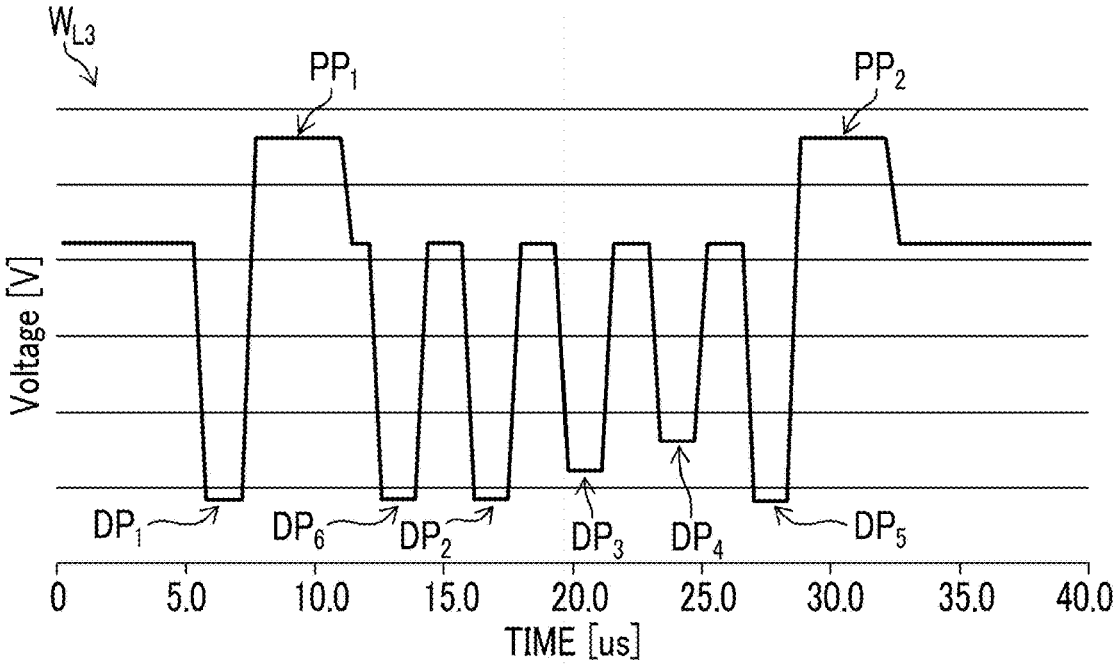
FIG. 31 is a timing chart illustrating the drive waveform of one drive cycle for forming the dot of the large droplet.

In addition, FIG. 31 is a timing chart illustrating a drive waveform $W_{L3}$ of one drive cycle for forming the dot of the large droplet in a case where the printing frequency is 25 kHz. The drive pulse $DP_1$, the dereverberation pulse $PP_1$, the drive pulses $DP_6$, $DP_2$, $DP_3$, $DP_4$, and $DP_5$, and the dereverberation pulse $PP_2$ are included in time series order from the beginning in the drive cycle. The drive waveform $W_{L3}$ is configured by adding the drive pulse $DP_6$ to the drive waveform $W_M$.

The preceding droplet ejected by the drive pulse $DP_1$ and the succeeding droplet ejected by the drive pulses $DP_6$, $DP_2$, $DP_3$, $DP_4$, and $DP_5$ are combined during their flight.

While two drive pulses having the same waveform are included in the drive waveform for forming the dot of the medium droplet, and the ejection timings of the two drive pulses are set as timings deviating from each other by ½ of the drive cycles, n drive pulses having the same waveform may be included, and the ejection timings of the n drive pulses may be set as timings deviating from each other by 1/n of the drive cycle. Even in this case, a deviation of approximately ±10% of 1/n of the drive cycle can be allowed for the interval among the arrangements of n drive pulses.

<Complementation of Defective Nozzle>

Figure 32:
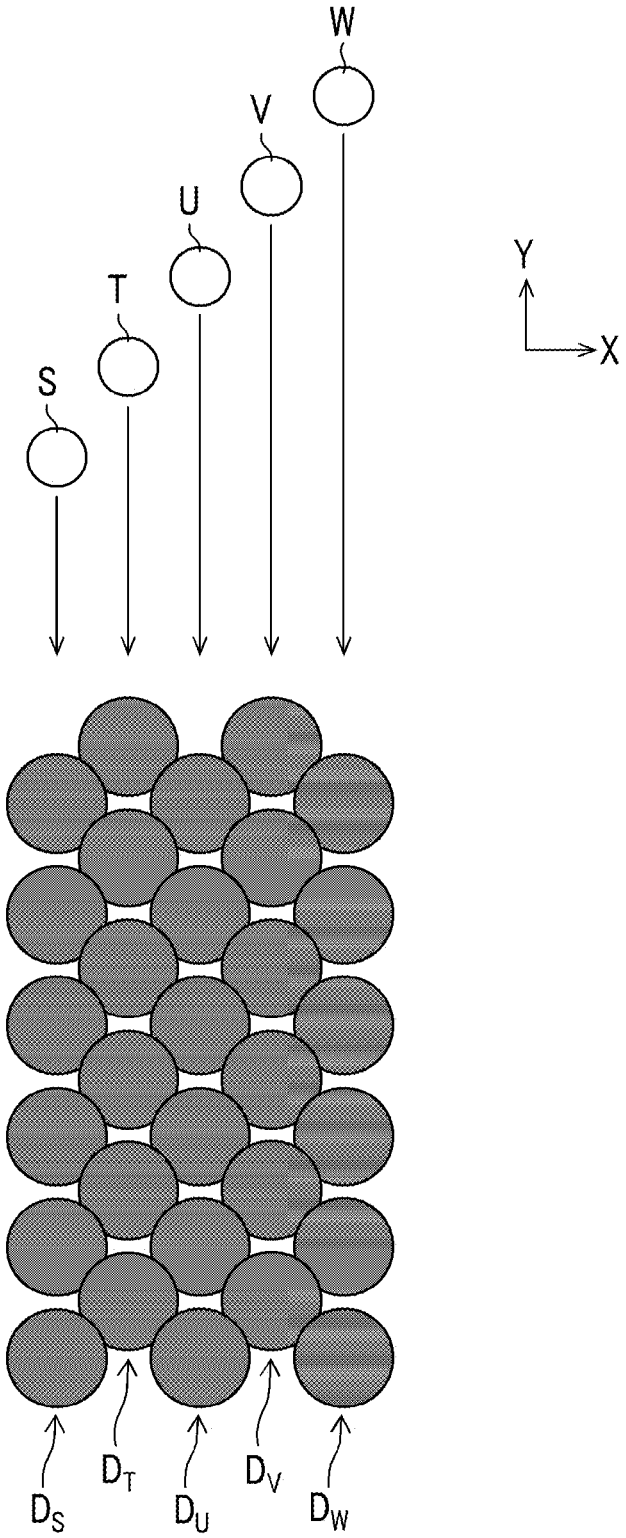
FIG. 32 is a schematic diagram for describing complementation of a defective nozzle.
Figure 33:
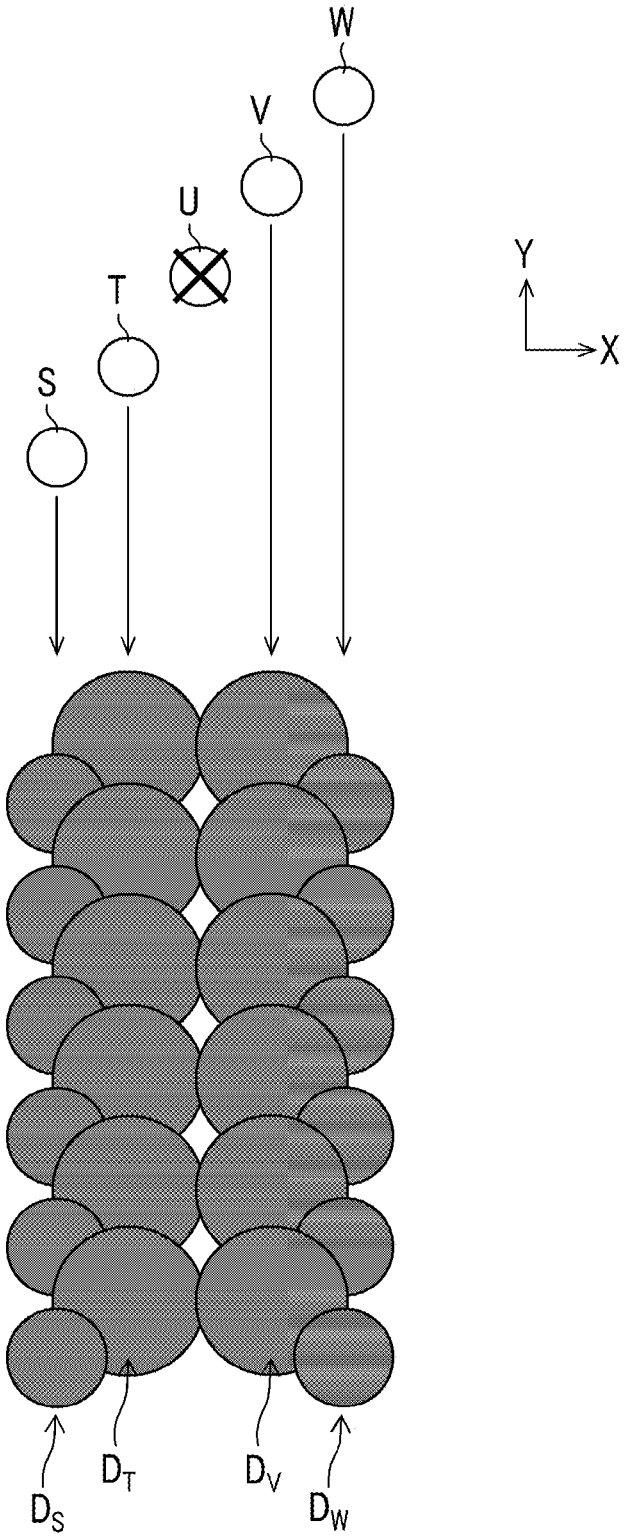
FIG. 33 is a schematic diagram for describing complementation of the defective nozzle.

FIG. 32 and FIG. 33 are schematic diagrams for describing complementation of the defective nozzle. FIG. 32 illustrates a nozzle S, a nozzle T, a nozzle U, a nozzle V, a nozzle W, and the dot data formed for each nozzle. The dot data is configured with a dot array $D_S$ to be formed by the nozzle S, a dot array $D_T$ to be formed by the nozzle T, a dot array $D_U$ to be formed by the nozzle U, a dot array $D_V$ to be formed by the nozzle V, and a dot array $D_W$ to be formed by the nozzle W, each including dots of the medium droplets.

In the defective nozzle specifying unit 76, the nozzle U is specified as the defective nozzle. In this case, the defect correction unit 78 corrects the dot data such that the nozzle U which is the defective nozzle does not perform ejection, and a dot to be formed by ejection of the nozzle U is complemented by the dot of the large droplet formed by ejection of the nozzle T and the nozzle V adjacent to the nozzle U in at least the X direction.

Consequently, as illustrated in FIG. 33, the dot data after correction is data configured with the dot array $D_S$ of the medium droplets to be formed by the nozzle S, the dot array $D_T$ of the large droplets to be formed by the nozzle T, the dot array $D_V$ of the large droplets to be formed by the nozzle V, and the dot array $D_W$ of the medium droplets to be formed by the nozzle W.

The defective nozzle is complemented by forming the dot of the large droplet by the nozzle adjacent to the defective nozzle in the X direction. The nozzle adjacent to the defective nozzle in the X direction does not necessarily form the dot of the large droplet. A pixel of no dot may be formed, and the density of the image may be adjusted.

<Others>

The image recording method according to the present embodiment can be configured as a program for causing a computer to execute each of the above steps, and a non-transitory recording medium such as a compact disk-read only memory (CD-ROM) on which the configured program is recorded.

The technical scope of the present invention is not limited to the scope disclosed in the embodiment. The configurations and the like in each embodiment can be appropriately combined between embodiments without departing from the gist of the present invention.

EXPLANATION OF REFERENCES

1: paper
10: ink jet recording device
20: transport drum
30: image recording unit
32: image recording drum
32A: gripper
34: paper pressing roller
36, 36C, 36M, 36Y, 36K: head
38: imaging unit
40: transport drum
42, 44: head module
50A: nozzle surface
51, A, B, C, D, E, F, G, H, I, J, K, S, T, U, V, W: nozzle
51A: nozzle plate
52: pressure chamber
52P: flow channel plate
53: ink chamber unit
54: supply port
55: common flow channel
56: vibration plate
57: individual electrode

58: piezo actuator
59: common electrode
60: system controller
62: communication unit
64: image memory
66: transport control unit
68: image recording control unit
70: pulse selection switch
72: operation unit
74: display unit
76: defective nozzle specifying unit
78: defect correction unit
80: waveform generation unit
82: digital analog conversion unit
84: switch controller
86: bias resistor
200: host computer
$D_{A1}$, $D_{A2}$, $D_{A3}$, $D_{A4}$: dot formed by nozzle A
$D_{B1}$, $D_{B2}$, $D_{B3}$, $D_{B4}$: dot formed by nozzle B
$D_{C1}$, $D_{C2}$, $D_{C3}$, $D_{C4}$: dot formed by nozzle C
$D_{D1}$, $D_{D2}$, $D_{D3}$, $D_{D4}$: dot formed by nozzle D
$D_{E1}$, $D_{E2}$, $D_{E3}$, $D_{E4}$: dot formed by nozzle E
$D_{F1}$, $D_{F2}$, $D_{F3}$, $D_{F4}$: dot formed by nozzle F
$D_{G1}$, $D_{G2}$, $D_{G3}$, $D_{G4}$: dot formed by nozzle G
$D_{H1}$, $D_{H2}$, $D_{H3}$, $D_{H4}$: dot formed by nozzle H
$D_{I1}$, $D_{I2}$, $D_{I3}$, $D_{I4}$: dot formed by nozzle I
$D_{I1F}$, $D_{I3F}$: dot based on preceding droplet
$D_{I1R}$, $D_{I3R}$: dot based on succeeding droplet
$D_{J1}$, $D_{J2}$, $D_{J3}$, $D_{J4}$: dot formed by nozzle J
$D_{K1}$, $D_{K2}$, $D_{K3}$, $D_{K4}$: dot formed by nozzle K
$D_{K1F}$, $D_{K3F}$: dot based on preceding droplet
$D_{K1R}$, $D_{K3R}$: dot based on succeeding droplet
$DP_1$, $DP_2$, $DP_3$, $DP_4$, $DP_5$, $DP_6$: drive pulse
DRL: ink droplet
$DRL_F$, $DRM_F$: preceding droplet
$DRL_R$, $DRM_R$: succeeding droplet
DRS: ink droplet
$D_S$, $D_T$, $D_U$, $D_V$, $D_W$: dot array
$G_1$: first ejection waveform element
$G_2$: second ejection waveform element
$G_3$: third ejection waveform element
P: pitch
$PP_1$: dereverberation pulse
$PP_2$: dereverberation pulse
$T_W$: drive cycle
$W_L$, $W_{L2}$, $W_{L3}$, $W_M$, $W_{M2}$, $W_S$, $W_{S2}$, $W_{S3}$: drive waveform
θ: angle

What is claimed is:

1. An image recording device comprising:

a liquid ejection head including a plurality of nozzles ejecting a liquid droplet, a plurality of pressure chambers respectively communicating with the plurality of nozzles, and a plurality of liquid droplet ejection elements pressurizing liquid in the plurality of pressure chambers, respectively, depending on a supplied drive waveform;

a dot forming unit that forms a dot on a recording medium by ejecting the liquid droplet from the plurality of nozzles based on dot data while relatively moving the liquid ejection head and the recording medium in a first direction;

a waveform supply unit that supplies a drive waveform for forming at least a dot of a small droplet, a dot of a medium droplet, or a dot of a large droplet of different sizes to the liquid ejection head depending on the dot data, the drive waveform including an ejection waveform element for ejecting the liquid droplet from the nozzle in one drive cycle;

a defect specifying unit that specifies a defective nozzle having an ejection malfunction among the plurality of nozzles; and a data acquisition unit that acquires the dot data which includes at least four gradations including the dot of the small droplet, the dot of the medium droplet, the dot of the large droplet, and no dot and complements a dot to be formed by ejection of the defective nozzle by the dot of the large droplet formed by ejection of a nozzle adjacent to the defective nozzle in at least a second direction intersecting the first direction, wherein the drive waveform for forming the dot of the small droplet is a drive waveform for ejecting the liquid droplet by a first ejection waveform element arranged in a first half of the one drive cycle, the drive waveform for forming the dot of the medium droplet is a drive waveform for ejecting the liquid droplet by the first ejection waveform element and a second ejection waveform element arranged after the first ejection waveform element in time series, and the liquid droplet ejected by the first ejection waveform element and the liquid droplet ejected by the second ejection waveform element are not combined while reaching onto the recording medium and are combined on the recording medium, and the drive waveform for forming the dot of the large droplet is a drive waveform for ejecting the liquid droplet by the first ejection waveform element and a third ejection waveform element that is arranged after the first ejection waveform element in time series and includes at least a part of the second ejection waveform element, and the liquid droplet ejected by the first ejection waveform element and the liquid droplet ejected by the third ejection waveform element are combined while reaching onto the recording medium.

2. The image recording device according to claim 1, wherein the first ejection waveform element includes at least one drive pulse for ejecting the liquid droplet and a dereverberation pulse that is arranged after the at least one drive pulse in time series and is for reducing meniscus vibration after liquid droplet ejection based on the at least one drive pulse, and the liquid droplet ejected by the second ejection waveform element and the liquid droplet ejected by the third ejection waveform element are ejected after the liquid droplet ejected by the first ejection waveform element is separated from the nozzle.

3. The image recording device according to claim 2, wherein in a case where ½ of an acoustic resonance cycle of a pressure wave in the pressure chamber is denoted by AL, each of an interval of a plurality of drive pulses included in the second ejection waveform element and an interval of a plurality of drive pulses included in the third ejection waveform element is 2 x AL.

4. The image recording device according to claim 1, wherein the dot forming unit includes a pulse selection switch that selects and outputs a drive waveform supplied from the waveform supply unit for forming dots of at least three sizes, in a case where ½ of an acoustic resonance cycle of a pressure wave in the pressure chamber is denoted by AL, a first period from the end of output of the first ejection waveform element until the start of output of the second ejection waveform element or the third ejection waveform element is longer than or equal to a settling time of the pulse selection switch and shorter than or equal to AL, and in a case where the drive waveform for forming the dot of the small droplet is output, the pulse selection switch is set to be OFF in the first period.

5. The image recording device according to claim 1, wherein the second ejection waveform element is the same waveform element as the first ejection waveform element.

6. The image recording device according to claim 5, wherein in the drive waveform for forming the dot of the medium droplet, an interval between the first ejection waveform element and the second ejection waveform element is ½ of the one drive cycle.

7. The image recording device according to claim 1, wherein the second ejection waveform element includes n waveform elements each being the same as the first ejection waveform element, and in the drive waveform for forming the dot of the medium droplet, an interval between the first ejection waveform element and the second ejection waveform element is 1/n of the one drive cycle.

8. The image recording device according to claim 1, wherein in a case where a distance from the nozzle to the recording medium is denoted by D, a droplet velocity of the liquid droplet ejected by the first ejection waveform element is denoted by $V_{MP}$, a droplet velocity of the liquid droplet ejected by the second ejection waveform element is denoted by $V_{MS}$, a time period of ejection based on the first ejection waveform element is denoted by $P_{MP}$, and a time period of ejection based on the second ejection waveform element is denoted by $P_{MS}$, the following expression is established:

$$D/V_{MP}+(P_{MS}-P_{MP})<D/V_{MS}.$$

9. The image recording device according to claim 1, wherein in a case where a distance from the nozzle to the recording medium is denoted by D, a droplet velocity of the liquid droplet ejected by the first ejection waveform element is denoted by $V_{LP}$, a droplet velocity of the liquid droplet ejected by the third ejection waveform element is denoted by $V_{LS}$, a time period of ejection based on the first ejection waveform element is denoted by $P_{LP}$, and a time period of ejection based on the third ejection waveform element is denoted by $P_{LS}$, the following expression is established:

$$D/V_{LP}+(P_{LS}-P_{LP})>D/V_{LS}.$$

10. The image recording device according to claim 1, wherein the defect specifying unit specifies a non-ejection nozzle not ejecting the liquid droplet and a deflected ejection nozzle for which a landing position error of the ejected liquid droplet exceeds an allowed value among the plurality of nozzles.

11. An image recording method comprising:

a dot forming step of forming a dot on a recording medium by ejecting a liquid droplet from a plurality of nozzles based on dot data while relatively moving a liquid ejection head and the recording medium in a first direction, the liquid ejection head including the plurality of nozzles ejecting the liquid droplet, a plurality of pressure chambers respectively communicating with the plurality of nozzles, and a plurality of liquid droplet ejection elements pressurizing liquid in the plurality of pressure chambers, respectively, depending on a supplied drive waveform;

a waveform supply step of supplying a drive waveform for forming at least a dot of a small droplet, a dot of a medium droplet, or a dot of a large droplet of different sizes to the liquid ejection head depending on the dot data, the drive waveform including an ejection waveform element for ejecting the liquid droplet from the nozzle in one drive cycle;

a defect specifying step of specifying a defective nozzle having an ejection malfunction among the plurality of nozzles; and a data acquisition step of acquiring the dot data which includes at least four gradations including the clot of the small droplet, the dot of the medium droplet, the clot of the large droplet, and no dot and complements a dot to be formed by ejection of the defective nozzle by the dot of the large droplet formed by ejection of a nozzle adjacent to the defective nozzle in at least a second direction intersecting the first direction, wherein the drive waveform for forming the dot of the small droplet is a drive waveform for ejecting the liquid droplet by a first ejection waveform element arranged in a first half of the one drive cycle, the drive waveform for forming the dot of the medium droplet is a drive waveform for ejecting the liquid droplet by the first ejection waveform element and a second ejection waveform element arranged after the first ejection waveform element in time series, and the liquid droplet ejected by the first ejection waveform element and the liquid droplet ejected by the second ejection waveform element are not combined while reaching onto the recording medium and are combined on the recording medium, and the drive waveform for forming the dot of the large droplet is a drive waveform for ejecting the liquid droplet by the first ejection waveform element and a third ejection waveform element that is arranged after the first ejection waveform element in time series and includes at least a part of the second ejection waveform element, and the liquid droplet ejected by the first ejection waveform element and the liquid droplet ejected by the third ejection waveform element are combined while reaching onto the recording medium.

* * * * *